United States Patent [19]

Okamura et al.

[11] Patent Number: 4,618,573

[45] Date of Patent: Oct. 21, 1986

[54] SILVER HALIDE COLOR PHOTOGRAPHIC MATERIAL

[75] Inventors: Hisashi Okamura; Hidetoshi Kobayashi; Toshihiro Nishikawa; Koji Tamoto, all of Kanagawa, Japan

[73] Assignee: Fuji Photo Film Co., Ltd., Kanagawa, Japan

[21] Appl. No.: 732,770

[22] Filed: May 10, 1985

[30] Foreign Application Priority Data

May 10, 1984 [JP] Japan ..... 59-093604

[51] Int. Cl.[4] ..... G03C 7/32; G03C 1/30

[52] U.S. Cl. ..... 430/558; 430/621; 430/623

[58] Field of Search ..... 430/558, 621, 623

[56] References Cited

U.S. PATENT DOCUMENTS

| | | | |
|---|---|---|---|
| 4,119,464 | 10/1978 | Sauerteig et al. | 430/621 |
| 4,233,398 | 11/1980 | Nittel et al. | 430/621 |
| 4,418,142 | 11/1983 | Langen et al. | 430/551 |
| 4,421,847 | 12/1983 | Jung et al. | 430/621 |
| 4,500,630 | 2/1985 | Sato et al. | 430/558 |

*Primary Examiner*—Mary F. Downey

*Attorney, Agent, or Firm*—Sughrue, Mion, Zinn, Macpeak & Seas

[57] ABSTRACT

A silver halide color photographic material containing a hardener capable of exerting a hardening effect through activation of a carboxyl group and a magenta coupler of the pyrazoloazole type, whereby lowering of color density of magenta images due to use of rapidly acting hardeners can be prevented.

19 Claims, No Drawings

SILVER HALIDE COLOR PHOTOGRAPHIC MATERIAL

FIELD OF THE INVENTION

The present invention relates to a color photographic material which contains a rapidly acting hardener and a magenta coupler of the pyrazoloazole type.

BACKGROUND OF THE INVENTION

In conventional photographic techniques, color images are usually obtained by the reaction of oxidation products of aromatic primary amine color developing agents, which are formed in the redox reaction of such agents and optically exposed silver halide, with dye-forming compounds known as couplers. Upon the reaction of a coupler with the oxidation product of a color developing agent, the coupler is coupled to the oxidized color developing agent at its reactive site called a coupling position to form a dye. Dyes formed in the coupling reaction are indoaniline dyes, azomethine dyes, indamine dyes or indophenol dyes, depending upon compositions of the couplers and the developing agents used. In a multicolor photographic element, the subtractive color process is generally employed for formation of color images, and the dyes formed therein upon coupling are, in general, cyan, magenta, and yellow dyes, produced in silver halide emulsion layers having sensitivities in the red, green, and blue regions of the spectrum, respectively. Alternatively, dyes may be formed in the layers adjacent to the silver halide emulsion layers. For the purpose of reduction of processing time, color photographic materials have increasingly been processed at temperatures higher than normal temperature (20°-25° C.), and processing at a temperature of 30° C. or above is very typical nowadays. Hydrophilic colloids, e.g., gelatin in which silver halides, couplers, and other additives are dispersed, are softened and swelled in the high temperature rapid processing. Consequently, the emulsion films are exposed to the peril of being damaged, or to peeling off of the support. Therefore, the emulsion layers must be hardened to withstand the high temperature development. The hardening is effected by passing the emulsion layers through a hardening solution initially in the development processing, or by adding a prehardener such as formaldehyde, dialdehyde, mucochloric acid or the like to silver halide emulsions at the time of preparation.

It is of prime importance to the hardening of photographic layers that the highest degree of hardness is achieved as quick as possible after drying, whereby a stable degree permeability of a developing solution into emulsion layers is ensured.

Recently, it has acquired a greater importance to use a hardener capable of acting rapidly for photographic purposes, instead of using one which exerts a hardening effect over many hours. The rapidity of the hardening reaction makes it feasible to avoid changes in properties of photographic materials during storage and continuous drop in permeability of a developing solution into photographic materials.

The expression "rapidly acting hardeners" is intended to include compounds which can cause cross-linking of gelatin in a very short time, if possible, during coating and/or drying. They must complete the cross-linking reaction within 24 hours.

Rapidly acting hardeners of interest include carbodiimides as described in U.S. Pat. Nos. 2,938,892 and 3,098,693, E. Schmidt, F. Hitzler and E. Lahde, Ber., Vol. 71, 1933 (1938), and, *Bull. Soc. Chim. France,* 1360 (1956); dihydroquinone compounds described in German Patent Application (OLS) No. 2,322,317; carbamoylpyridinium compounds described in German Patent Application (OLS) Nos. 2,225,230, 2,317,677 and 2,439,551; and carbamoyloxypyridinium compounds described in German Patent Application (OLS) No. 2,408,814.

One of the characteristics common to the above-described rapidly acting hardeners is that they can activate a carboxyl group. This function can be illustrated by the known reaction of carbodiimide with carboxylic acid. In this reaction, an N-acylurea or an acid anhydride is employed as the active group. In the case of proteins which have both carboxyl and amino group, the reaction further proceeds to result in the formation of peptide linkages between an activated carboxyl group and an amino group. Therefore, compounds of such a kind are known as peptide reagent (*Chemical Review,* Vol. 67, pp. 107-152 (1967)).

However, the compounds of the above-described kind retard development in a magenta color-forming layer. Accordingly, utilization of these compounds as rapidly acting hardeners in color photographic materials has been limited.

SUMMARY OF THE INVENTION

An object of the present invention is to provide a color photographic material in which a rapidly acting hardener is incorporated, wherein there is little or no damage to formation of a magenta image from rapid hardening prior to photographic processing.

It has now been found that the above-described object can be attained with a silver halide color photographic material containing a hardener capable of exerting a hardening effect through activation of a carboxyl group and a magenta coupler of pyrazoloazole type.

DETAILED DESCRIPTION OF THE INVENTION

Magenta couplers employed in the present invention do not substantially undergo side reactions with a rapidly acting hardener, differing from four-equivalent couplers of the 5-pyrazolone type. Therefore, formation of magenta images is substantially not at all impaired.

Pyrazoloazole couplers preferably employed in the present invention are represented by formula (I).

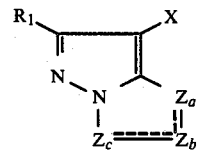

(I)

In formula (I), $R_1$ represents a hydrogen atom or a certain substituent group; X represents a hydrogen atom or a group capable of being split off by a coupling reaction with an oxidized aromatic primary amine developing agent; and $Z_a$, $Z_b$, and $Z_c$ each represents a methine group, a substituted methine group, =N—, or —NH—. The substituent represented by $R_1$ includes a non-metallic aromatic residue containing a carbon atom, a nitrogen atom, an oxygen atom, a sulfur atom or a phosphorus atom as a connecting atom which attaches to the pyrazoloazole ring, e.g., a substituted or unsubstituted alkyl group, a substituted or unsubstituted anilino group and acyl group.

Compounds represented by formula (I) are couplers of such a condensed-ring type that two nitrogen-containing 5-membered heterocyclic rings are fused together, and their chromophoric mother nuclei demonstrate aromaticity similar to that of naphthalene as if they were isoelectronic to naphthalene, and the chemical structure thereof is generically called azapentalene. Of the couplers represented by formula (I), those which are used to greater advantage in the present invention are 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles and 1H-pyrazolo[1,5-d]tetrazoles, which are represented by formulae (II), (III), (IV), (V) and (VI), respectively.

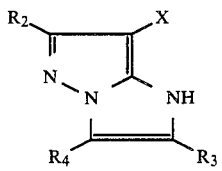
(II)

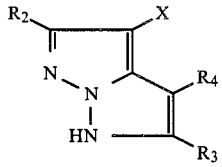
(III)

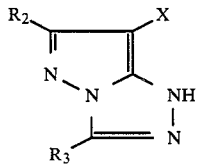
(IV)

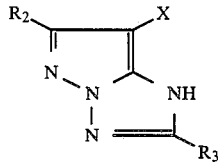
(V)

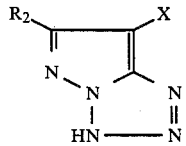
(VI)

Substituent groups, $R_2$, $R_3$, and $R_4$, in the foregoing formulae (II) or (VI) can each represent an aliphatic group, an aromatic group, or a heterocyclic group, each of which may be substituted with a known substituent therefor (for example, a halogen atom, an alkyl group, an alkynyl group, an aryl group, a heterocyclic group, an alkoxy group, an aryloxy group, an acyloxy group, a sulfonyloxy group, an acyl group, a sulfonyl group, a carboxyl group, a sulfo group, a hydroxyl group, an amino group, a carbonamido group, a sulfonamido group, a carbamoyl group, a sulfamoyl group, an alkoxycarbonyl group, an aryloxycarbonyl group, an ureido group, a sulfinyl group, an alkylthio group, an arylthio group, a cyano group, etc.). Further, $R_2$, $R_3$, and $R_4$ can each represent a hydrogen atom. In addition, $R_2$, $R_3$, and $R_4$ can each represent a halogen atom, an alkyl group, an alkynyl group, an aryl group, a heterocyclic group, an alkoxy group, an aryloxy group, an acyloxy group, a sulfonyloxy group, an acyl group, a sulfonyl group, a carboxyl group, a sulfo group, a hydroxyl group, an amino group, a carbonamido group, a sulfonamido group, a carbamoyl group, a sulfamoyl group, an alkoxycarbonyl group, an aryloxycarbonyl group, an ureido group, a sulfinyl group, an alkylthio group, an arylthio group, a cyano group, etc. These groups can further be substituted with a known substituent therefor as recited above. For example, the substituent for an amino group includes an aryl group and an alkyl group. X represents a hydrogen atom or a group capable of being split off by coupling reaction with an oxidation product of an aromatic primary amine developing agent (which is called an split-off group hereinafter). When X represents a split-off group, it includes such groups as to link the coupling active carbon to an aliphatic group, an aromatic group, a heterocyclic group, an aliphatic, aromatic or heterocyclic sulfonyl group, or an aliphatic, aromatic or heterocyclic carbonyl group through an oxygen atom, a nitrogen atom, a sulfur atom or a carbon atom; halogen atoms; aromatic azo groups; and so on. The aliphatic, aromatic, or heterocyclic moiety contained in these split-off groups may be substituted with substituent groups as described above $R_2$, $R_3$ and $R_4$. When those moieties are substituted with two or more of such substituents, the substituents may be same or different. Specific examples of split-off groups include halogen atoms (e.g., F, Cl, Br, etc.), alkoxy groups (e.g., ethoxy group, dodecyloxy group, methoxyethylcarbamoylmethoxy group, carboxypropoxy group, methanesulfonylethoxy group, etc.), aryloxy groups (e.g., 4-chlorophenoxy group, 4-methoxyphenoxy group, 4-carboxyphenoxy group, etc.), acyloxy groups (e.g., acetoxy group, tetradecanoyloxy group, benzoyloxy group, etc.), aliphatic or aromatic sulfonyloxy groups (e.g., methanesulfonyloxy group, toluenesulfonyloxy group, etc.), acylamino groups (e.g., dichloroacetylamino group, trifluoroacetylamino group, heptafluorobutylylamino group, etc.), aliphatic or aromatic sulfonamido groups (e.g., methanesulfonamido group, p-toluenesulfonamido group, etc.) alkoxycarbonyloxy groups (e.g., ethoxycarbonyloxy group, benzyloxycarbonyloxy group, etc.), aryloxycarbonyloxy groups (e.g., phenoxycarbonyloxy group, etc.), aliphatic, aromatic or heterocyclic thio groups (e.g., ethylthio group, phenylthio group, etc.), carbamoylamino groups (e.g., N-methylcarbamoylamino group, N-phenylcarbamoylamino group, etc.), 5- or 6-membered nitrogen-containing heterocyclic groups (e.g., imidazolyl group, pyrazolyl group, triazolyl group, tetrazolyl group, 1,2-dihydro-2-oxo-1-pyridyl group, etc.), imido groups (e.g., succinimido group, hydantoinyl group, etc.), aromatic azo groups (e.g., phenylazo group, etc.) and so on. These groups may also be substituted with substituent groups as described above for $R_2$, $R_3$, and $R_4$. Furthermore, in the case that split-off group is attached to the coupling active site through a carbon atom, it may be an aldehyde or a ketone. Therein, four-equivalent couplers are condensed by the split-off group to form a bis-type coupler.

One of substituent groups $R_2$, $R_3$, $R_4$, and X may be a divalent group, may even have a higher valence state, i.e., it may be a polyvalent group. When two or more couplers are linked by such substituents, a dimeric or a polymeric coupler is formed, while when couplers are attached to the main chain of a macromolecule by such substituents a macro-molecular coupler is formed.

Examples of the couplers represented by formulae (II) to (IV) and methods for synthesizing them are described in the literature, as follows. Compounds of formula (II) are described in Japanese Patent Application (OPI) No. 162548/84 and so on, compounds of formula (III) are described in Japanese Patent Application No. 15134/83 and so on, compounds of formula (IV) are described in Japanese Patent Publication No. 27411/72 and so on, compounds of formula (V) are described in Japanese Patent Application (OPI) No. 171956/84 and U.S. application Ser. No. 702,691, filed Feb. 19, 1985, etc., and compounds of formula (VI) are described in Japanese Patent Application (OPI) No. 33552/85 and so on (the "OPI" as used herein refers to a "published unexamined Japanese patent application").

Ballast groups which can contribute greatly to color formation, as described in Japanese Patent Application (OPI) Nos. 42045/83, 214854/84, 177553/84, 177554/84 and 177557/84, and so on, can be present in any of the foregoing compounds of formulae (II) to (IV).

It has surprisingly been found that the magenta couplers employed according to the present invention differ from pyrazolone four-equivalent couplers and do not substantially undergo side reactions with rapidly acting hardeners, and therefore form magneta images with little or no influence due to the hardener.

Specific examples of magenta couplers which can be employed in the present invention are illustrated below. However, the present invention is not to be construed as being limited to the following examples.

(M-1)

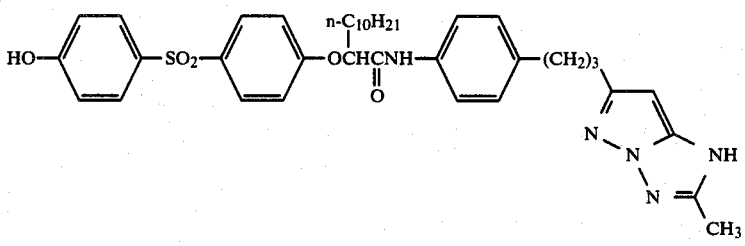

(M-2)

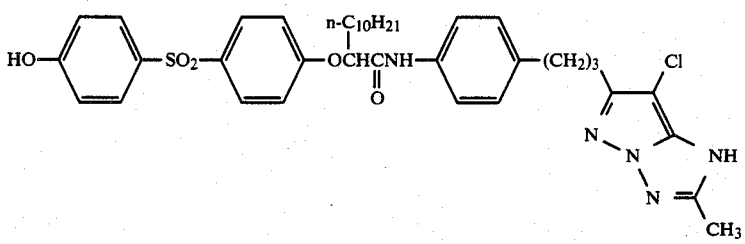

(M-3)

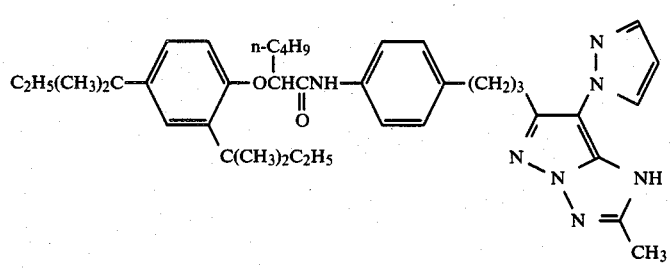

(M-4)

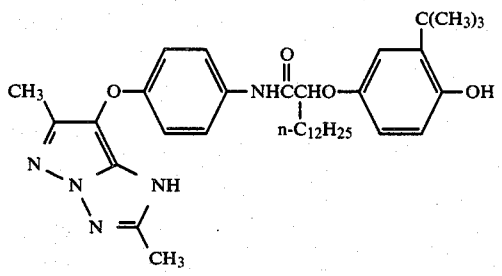

-continued
(M-5)
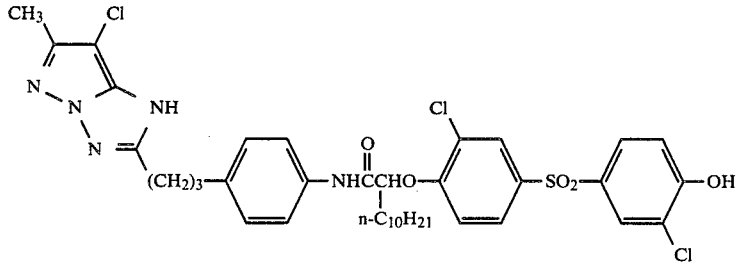
(M-6)
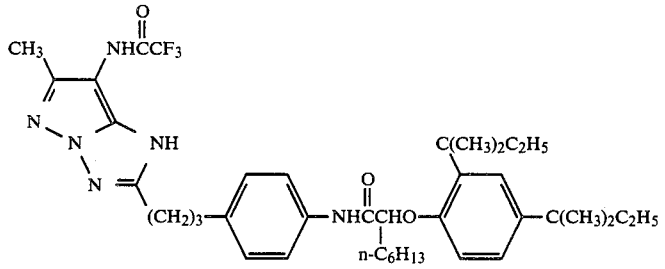
(M-7)
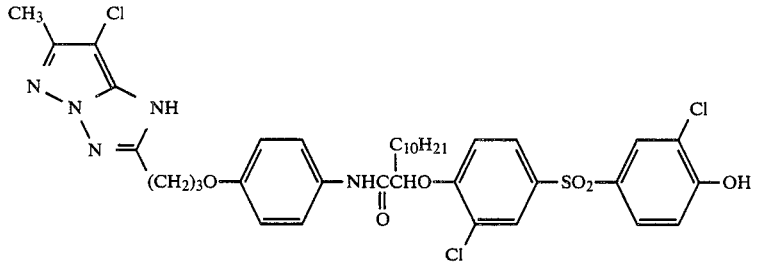
(M-8)
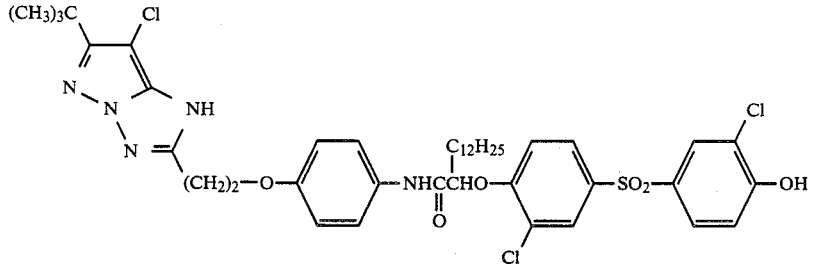
(M-9)
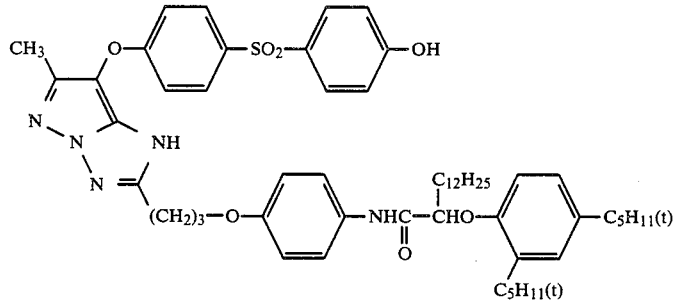
(M-10)
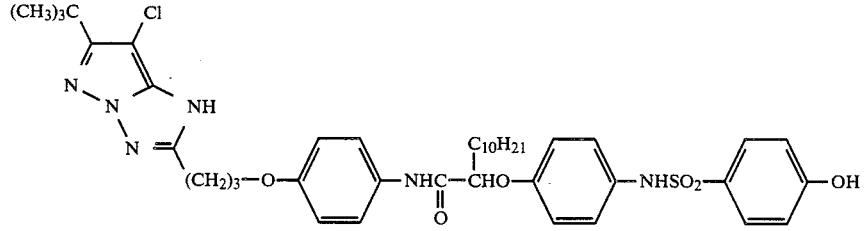

-continued
(M-11)
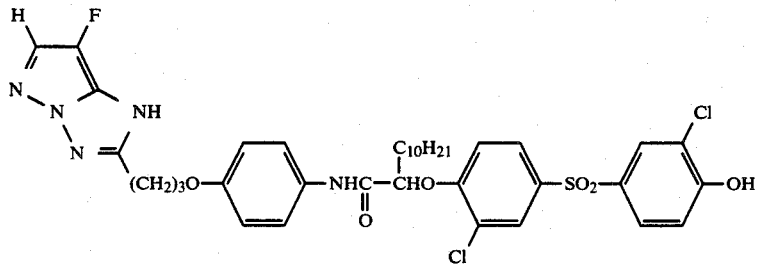
(M-12)
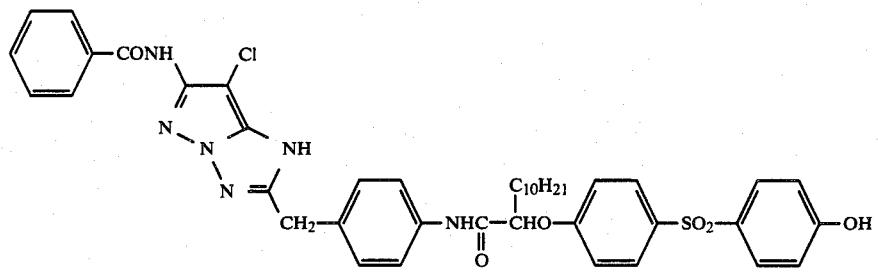
(M-13)
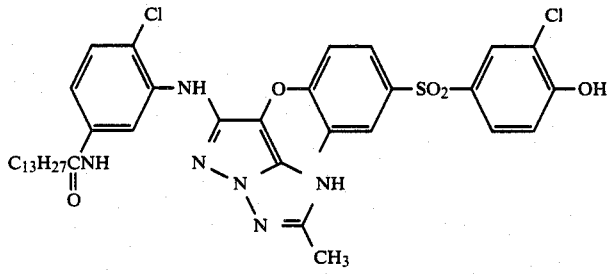
(M-14)
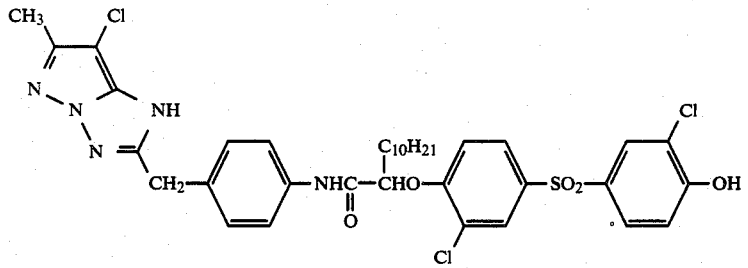
(M-15)
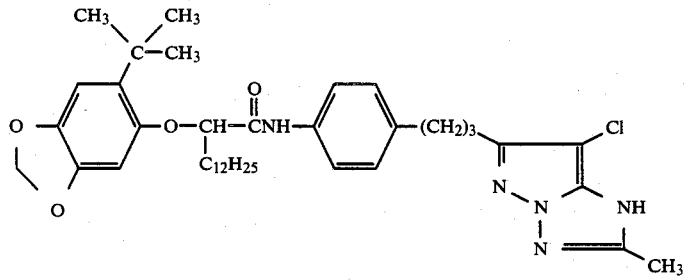
(M-16)
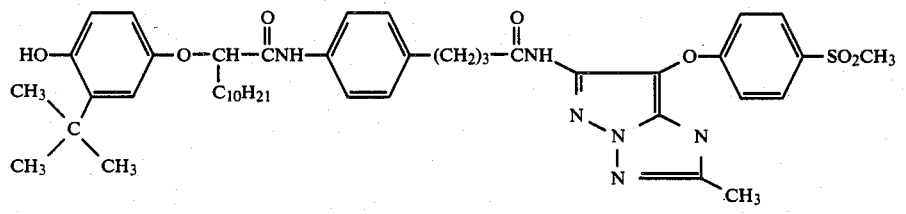

-continued
(M-17)
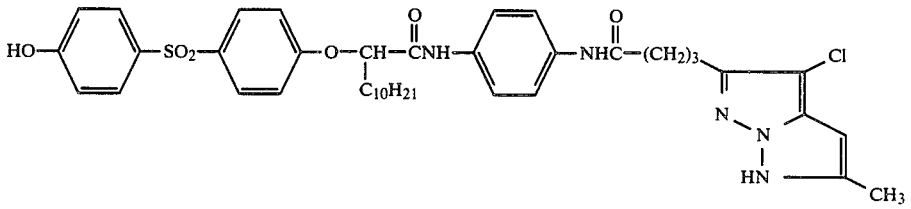
(M-18)
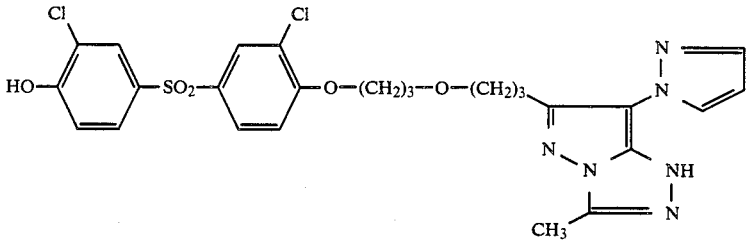
(M-19)
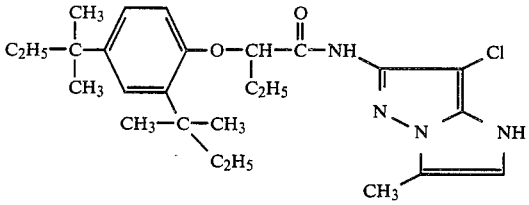
(M-20)
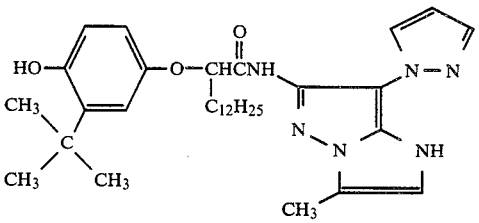
(M-21)
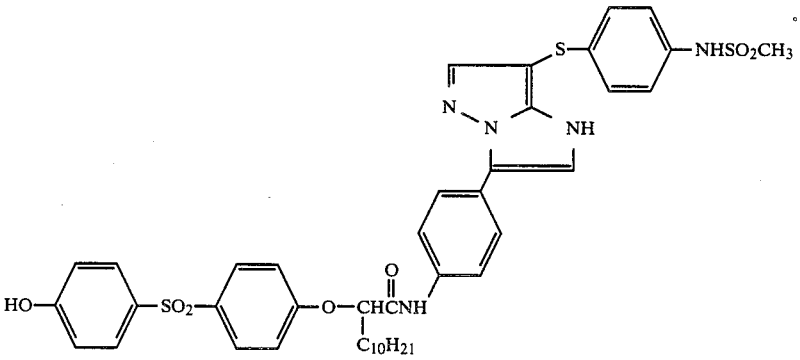
(M-22)
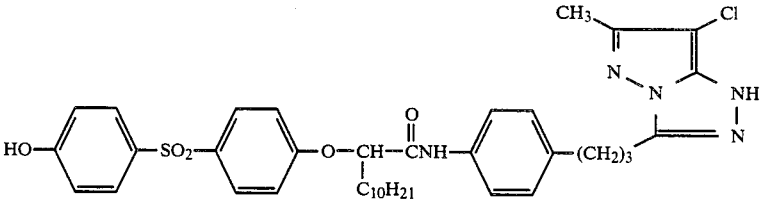

-continued (M-23)

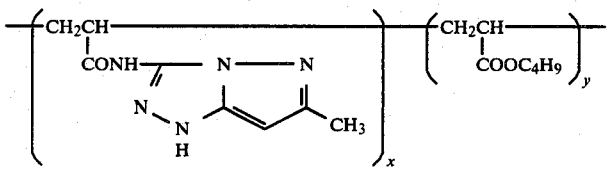

x/y = 50/50 (wt)

(M-24)

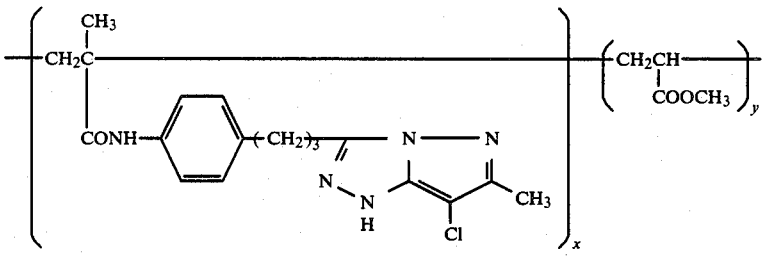

x/y = 40/60 (wt)

(M-25)

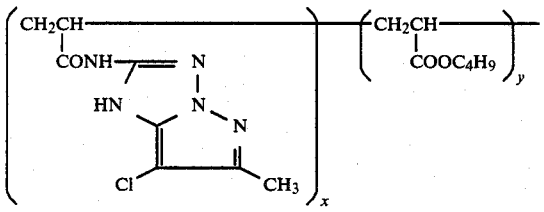

x/y = 50/50 (wt)

(M-26)

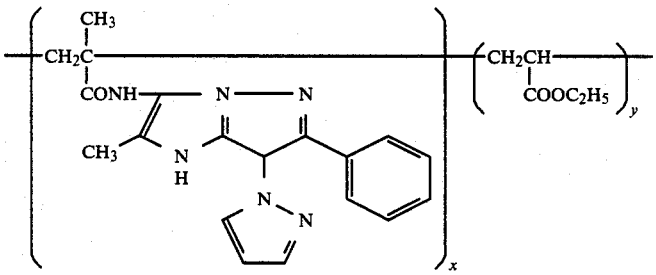

x/y = 55/45 (wt)

(M-27)

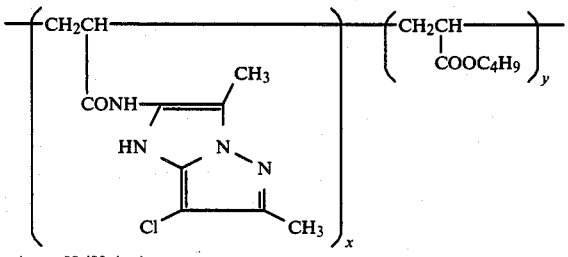

x/y = 50/50 (wt)

As examples of hardeners of the carboxyl group activating type which can be used to advantage in the present invention include compounds represented by formulae (VII) to (XII).

In the hardeners of formula (VII)

(VII)

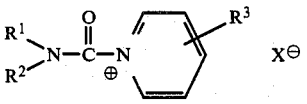

$R^1$ and $R^2$ (which may be same or different) each represents an alkyl group containing from 1 to 10 carbon atoms (e.g., methyl, ethyl, 2-ethylhexyl, etc.), an aryl group containing from 6 to 15 carbon atoms (e.g., phenyl, naphthyl, etc.) or an aralkyl group containing from 7 to 15 carbon atoms (e.g., benzyl, phenethyl, etc.), or they may combine with each other to form a heterocyclic ring together with the nitrogen atom (e.g., a pyrrolidine ring, a piperazine ring, a morpholine ring, etc.); $R^3$ represents a hydrogen atom, a halogen atom, a carbamoyl group, a sulfo group, an ureido group, an alkoxy group containing from 1 to 10 carbon atoms, an alkyl group containing from 1 to 10 carbon atoms, and so on. When $R^3$ represents an alkyl or an alkoxy group as described above, these groups each may be further substituted with a halogen atom, a carbamoyl group, a sulfo group, an ureido group, and so on. $X^{\ominus}$ in the foregoing formula represents an anion, and acts as a counter ion to the N-carbamoylpyridinium ion to form a salt, or it may be absent therein when $R^3$ contains a sulfo group as a constituent group and thereby an intramolecular salt is formed. Suitable examples of an anion represented by $X^{\ominus}$ include halide ions, sulfonic acid ion, sulfonate ion, $ClO_4^{\ominus}$, $BF_4^{\ominus}$, $PF_6^{\ominus}$ and so on.

In the hardeners of formula (VIII)

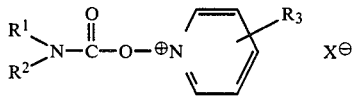

(VIII)

$R^1$, $R^2$, $R^3$, and $X^{\ominus}$ have the same meanings as in formula (VII), respectively.

In the hardeners of formula (IX)

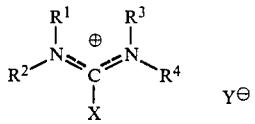

(IX)

$R^1$, $R^2$, $R^3$, and $R^4$ (which may be same or different) each represents an alkyl group containing from 1 to 20 carbon atoms (e.g., methyl, ethyl, butyl, 2-ethylhexyl, dodecyl, etc.), an aralkyl group containing from 6 to 20 carbon atoms (e.g., benzyl, phenethyl, 3-pyridylmethyl, etc.), or an aryl group containing from 5 to 20 carbon atoms (e.g., phenyl, naphthyl, pyridyl, etc.). These groups each may include a substituent group (e.g., a halogen atom, a sulfo group, an alkoxy group containing from 1 to 20 carbon atoms, an aryloxy group containing from 6 to 20 carbon atoms, an N,N-disubstituted carbamoyl group, etc.).

Therein, it is also possible for any two groups selected from $R^1$, $R^2$, $R^3$, and $R^4$ to combine with each other to form a ring. For instance, there is a case that $R^1$ and $R^2$, or $R^3$ and $R^4$ combine with each other and form a ring together with a nitrogen atom. Specific examples of a ring formed in such a case include a pyrrolidine ring, a piperazine ring, a perhydroazepine ring, a morpholine ring, and so on. In another case, $R^1$ and $R^3$, or $R^2$ and $R^4$ combine with each other and form a ring together with two nitrogen atoms and one carbon atom sandwiched therebetween. Specific examples of a ring to be formed in such a case include an imidazoline ring, a tetrahydropyrimidine ring, a tetrahydrodiazepine ring and so on.

X in formula (IX) represents a group capable of being split off from the compound of formula (IX) upon the reaction with a nucleophilic reagent, with suitable examples including a halogen atom, a sulfonyloxy group, a 1-pyridiniumyl group and so on. $Y^{\ominus}$ in the foregoing formula (IX) represents an anion, with suitable examples including a halide ion, a sulfonate ion, a sulfuric acid ion, $ClO_4^{\ominus}$, $BF_4^{\ominus}$, $PF_6^{\ominus}$ and so on. When any of of $R^1$, $R^2$, $R^3$ and $R^4$ has a sulfo group, a hardener having formula (IX) can form an intramolecular salt without any independent counteranion represented by $Y^{\ominus}$.

In the hardeners of formula (X)

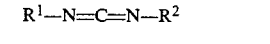

(X)

$R^1$ represents an alkyl group containing from 1 to 10 carbon atoms (e.g., methyl, ethyl, 2-ethylhexyl, etc.), a cycloalkyl group containing from 5 to 8 carbon atoms (e.g., cyclohexyl, etc.), an alkoxyalkyl group containing from 3 to 10 carbon atoms (e.g., methoxyethyl, etc.), or an aralkyl group containing from 7 to 15 carbon atoms (e.g., benzyl, phenetyl, etc.). In the foregoing formula (X), it is desirable for $R^2$ to represent a group of the following formula in addition to the groups defined as $R^1$:

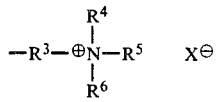

wherein $R^3$ represents an alkylene group containing from 2 to 4 carbon atoms (e.g., ethylene, propylene, trimethylene, etc.); and $R^4$ and $R^5$ (which may be same or different) each represents an alkyl group containing from 1 to 6 carbon atoms (e.g., methyl, ethyl, etc.), or it is also desirable for them to combine with each other to form a heterocyclic ring together with a nitrogen atom (e.g., pyrrolidine, piperazine, morpholine, etc.). $R^6$ in the foregoing formula represents an alkyl group containing 1 to 6 carbon atoms (e.g., methyl, ethyl, butyl, etc.), which is preferably substituted with a certain substituent. Suitable examples of such a substituent include unsubstituted and substituted carbamoyl groups and sulfo group. $X^{\ominus}$ therein represents an anion, with suitable examples including halide ions, sulfonate ions, sulfuric acid ions, $ClO_4^{\ominus}$, $BF_4^{\ominus}$, $PF_6^{\ominus}$ and so on. When the hardener of formula (X) forms an intramolecular salt, the counteranion represented by $X^{\ominus}$ is not necessary.

In the hardeners of formula (XI)

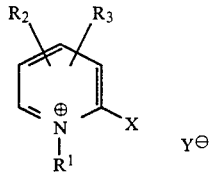

(XI)

$R^1$ represents an alkyl group containing from 1 to 10 carbon atoms (e.g., methyl, ethyl, butyl, etc.), an aryl group containing from 6 to 15 carbon atoms (e.g., phenyl, naphtyl, etc.), or an aralkyl group containing from 7 to 15 carbon atoms (e.g. benzyl phenethyl, etc.). These groups each may be substituted with a certain substituent. Suitable examples of such substituents include a carbamoyl group, a sulfamoyl group, a sulfo group, and so on. $R^2$ and $R^3$ in formula (XI) (which may be same or different) each represents a hydrogen atom, a halogen atom, an acylamido group, a nitro group, a carbamoyl group, an ureido group, an alkoxy group, an alkyl group, an alkenyl group, an aryl group, an aralkyl group or so on. Further, it is also desirable that $R^2$ and $R^3$ combine with each other and form a condensed ring together with the pyridinium ring skeleton.

X in the formula (XI) represents such a group to be split off from the compound represented by the formula (XI) upon the reaction with a nucleophilic reagent, with preferred examples including halogen atoms, sulfonyloxy group, or groups represented by $-\underset{\underset{C}{\|}}{O}P(OR^4)_2$ wherein $R^4$ represents an alkyl group or an aryl group. When X represents a sulfonyloxy group, it is also desirable that X is attached to $R^1$.

$Y^{\ominus}$ in the formula (XI) represents an anion, with preferred examples including halide ions, sulfonate ions, sulfuric acid ions, $ClO_4^{\ominus}$, $BF_4^{\ominus}$, $PF_6^{\ominus}$ and the like. However, $Y^{\ominus}$ may be absent when $R^1$ is a sulfo-substituted group, whereby, the compound forms an intramolecular salt.

In the hardeners of formula (XII)

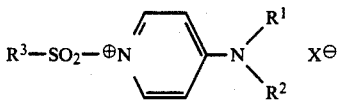

(XII)

$R^1$ and $R^2$ have the same meanings as defined as $R^1$ and $R^2$ in formula (VII), and $R^3$ represents an alkyl group containing from 1 to 10 carbon atoms (e.g., methyl, ethyl, butyl, etc.), an aryl group containing from 6 to 15 carbon atoms (e.g., phenyl, naphthyl, etc.), or an aralkyl group containing from 7 to 15 carbon atoms (e.g., benzyl, phenethyl, etc.). $X^{\ominus}$ therein represents an anion, with preferred examples including halide ions, sulfonate ions, sulfuric acid ions, $ClO_4^{\ominus}$, $BF_4^{\ominus}$, $PF_6^{\ominus}$, and the like.

In addition to the hardeners represented by the foregoing formulae (VI) to (XII), compounds described in Japanese Patent Application (OPI) Nos. 38540/75, 93470/77, 43353/81 and 113929/83, and U.S. Pat. No. 3,321,313 are also employed to advantage as hardeners of the carboxyl group activating type.

Specific examples of hardeners of the above-described type which can be used to greater advantage are illustrated below. However, the present invention should not be construed as being limited to the following examples.

(a) Compounds of formula (VII)

Methods for synthesizing these compounds are described in detail in Japanese Patent Application (OPI) Nos. 51945/74 and 59625/76.

H-1

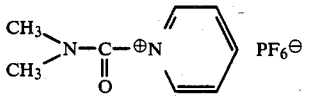

H-2

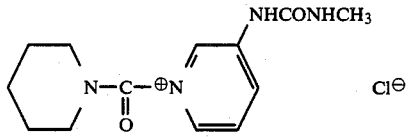

H-3

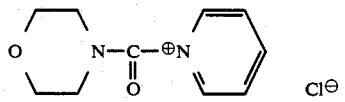

-continued

H-4

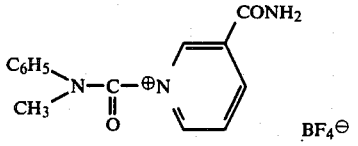

H-5

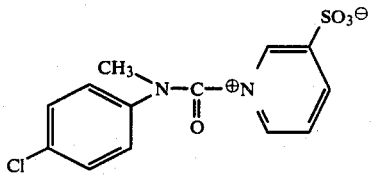

H-6

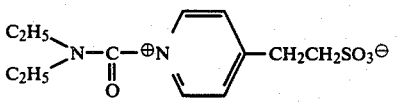

H-7

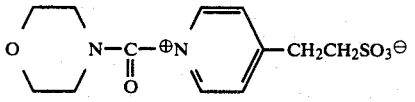

H-8

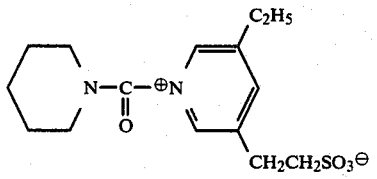

(b) Compounds of formula (VIII)

Methods for synthesizing these compounds are described in detail, e.g., in Belgian Pat. No. 825,726.

H-9

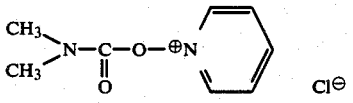

H-10

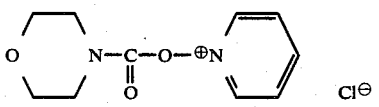

H-11

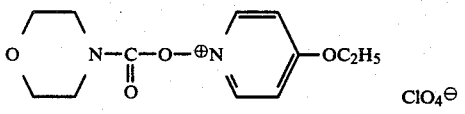

H-12

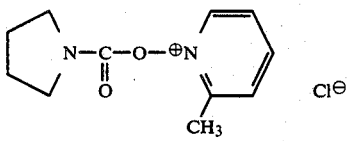

H-13

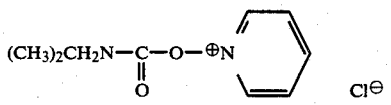

(c) Compounds of formula (IX)

Methods for synthesizing these compounds are described in detaidl in *Chemistry Letters (The Chemical Society of Japan), p.* 1891–1894 (1982).

H-14

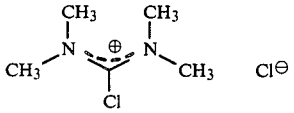

H-15

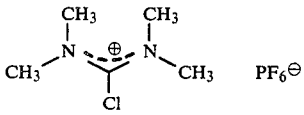

H-16

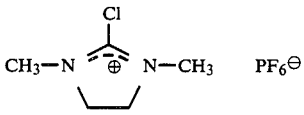

H-17

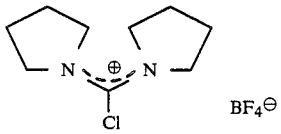

H-18

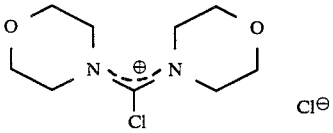

H-19

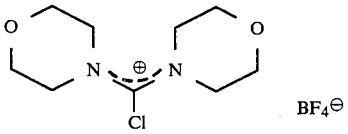

H-20

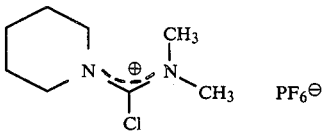

H-21

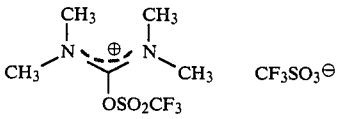

(d) Compounds of formula (X)

Methods for synthesizing these compounds are described in detail in Japanese Patent Application (OPI) Nos. 126125/76 and 48311/77.

H-22

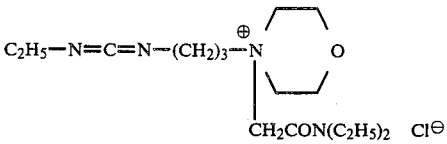

H-23

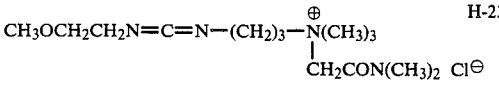

-continued

H-24

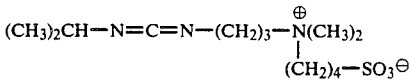

H-25

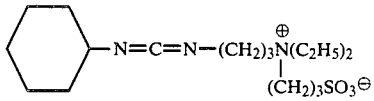

H-26

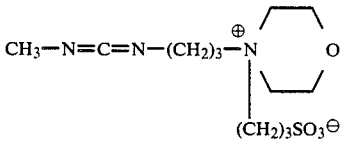

H-27

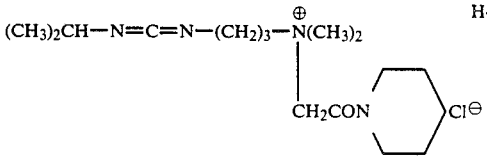

H-28

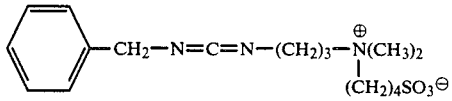

(e) Compounds of formula (XI)

Methods for synthesizing these compounds are described in detail in Japanese Patent Application (OPI) Nos. 44140/82 and 46538/82, and Japanese Patent Publication No. 50669/83.

H-29

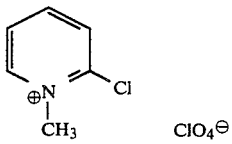

H-30

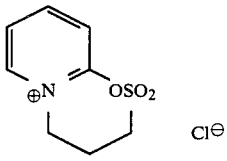

H-31

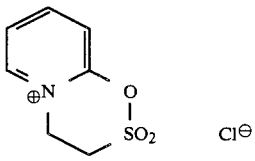

H-32

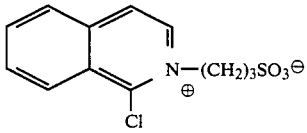

-continued

H-33

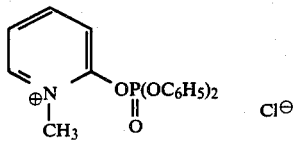

H-34

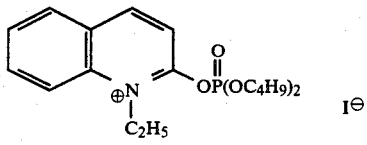

(f) Compounds of formula (XII)

Methods for synthesizing these compounds are described in detail in Japanese Patent Application (OPI) No. 54427/77.

H-35

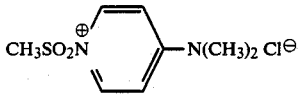

H-36

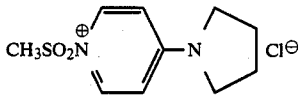

H-37

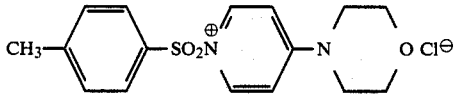

(g) Compounds described in Japanese Patent Application (OPI) No. 38540/75

H-38

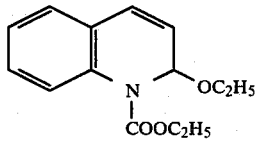

H-39

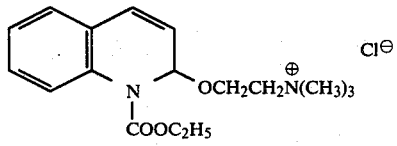

H-40

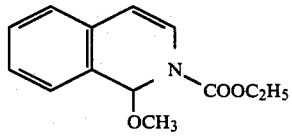

(h) Compounds described in Japanese Patent Application (OPI) No. 93470/77

H-41

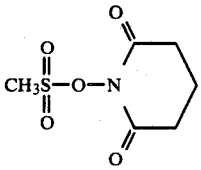

H-42

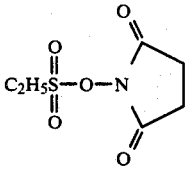

(i) Compounds described in Japanese Patent Application (OPI) No. 43353/81

H-43

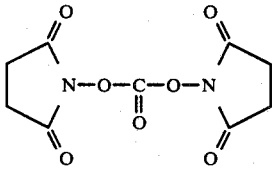

H-44

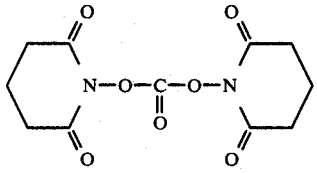

H-45

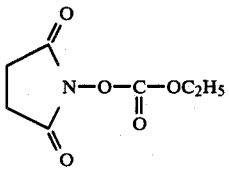

(j) Compounds described in Japanese Patent Application (OPI) No. 113929/83

H-46

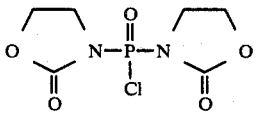

H-47

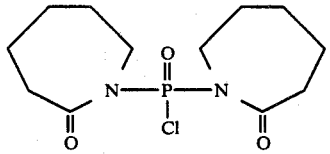

(k) Compounds described in U.S. Pat. No. 3,321,313

H-48

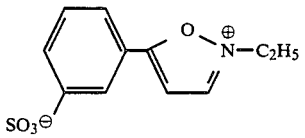

H-49

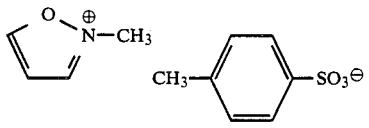

H-50

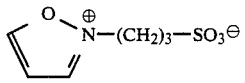

H-51

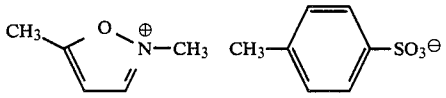

H-52

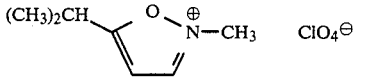

H-53

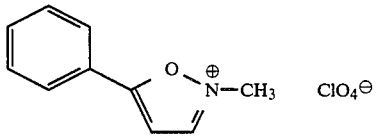

H-54

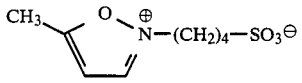

When hardeners as represented by formulae (VII) to (XII) are incorporated in photographic layers, undesirable phenomena such as deterioration of photographic properties (e.g., fog, desensitization, etc.), generation of stain, reaction with couplers incorporated in a color photographic material and so on, are hardly observed. In addition, the hardening proceeds very rapidly, and the final hardness can be attained within several days' time after the coating step. Thereafter, an increasing phenomenon in hardness, that is, after-hardening, is substantially not observed.

The compounds as illustrated above are excellent in affinity to water, and therefore do not require any special organic solvents for addition to photographic layers. Consequently, conventional problems due to the use of organic solvents, such as coating unevenness and the like, do not occur. Furtheremore, it becomes unnecessary to take precautions against explosion. In addition, the foregoing compounds are not known to have any particular physiological effects, and their vapor pressures are low. Therefore, they do not so far as is known, exhibit any adverse influences upon the human body.

The amount of such a hardener to be used in the present invention can be determined arbitrarily depending upon the particular end-use purpose. Preferably, it is used in an amount of from 0.01 to 20% by weight based on the amount of dry gelatin (water content: about 7 to 13%) used. It is more preferred to use it in an amount of from 0.05 to 10% by weight.

The hardeners of the present invention can be used effectively as hardener for partial hardening in the method of enlongating the chain length of gelatin through partial hardening, as described in Japanese Patent Application (OPI) No. 2324/81. In addition, they can be employed for hardening gelatins whose chain lengths have been enlongated using the above-described method.

The hardeners of the present invention can be employed in all gelatin-using photographic materials. Specific examples of such photographic materials include color negative films, color reversal films, color positive films, color photographic paper, color reversal photographic paper, color photosensitive materials for a color diffusion transfer process or a silver dye bleach process, and black-and-white photosensitive materials such as black-and-white films, X-ray films, process films, black-and-white photographic paper, aerial films, microfilms, facsimile films, films and photographic paper for photocomposition, films for graphs and so on.

In such materials, the hardeners of the present invention are not particularly restricted as to the photographic layer(s) in which they are to be incorporated. They can be incorporated not only in silver halide emulsion layers, but also in light-sensitive layers such as a subbing layer, a backing layer, a filter layer, an interlayer, an overcoat layer and so on.

The hardeners of the present invention may be used alone, as a mixture of two or more thereof, or in combination with other known hardeners. Specific examples of hardeners which can be used in combination with the hardeners of the present invention include aldehyde compounds such as formaldehyde, glutaraldehyde and the like, ketone compounds such as diacetyl, cyclopentanedione and the like, compounds having reactive halogens such as bis(2-chloroethylurea), 2-hydroxy-4,6-dichloro-1,3,5-triazine and like compounds described in U.S. Pat. Nos. 3,288,775 and 2,732,303, British Pat. Nos. 974,723 and 1,167,207, and so on, compounds having reactive olefins such as divinylsulfone, 5-acetyl-1,3-diacryloylhexahydro-1,3,5-triazine and like compounds described in U.S. Pat. Nos. 3,635,718 and 3,232,763, British Pat. No. 994,869, Japanese Patent Application (OPI) Nos. 41221/78 and 57257/78, and so on, N-methylol compounds such as N-hydroxymethylphthalimide and like compounds described in U.S. Pat. Nos. 2,732,316 and 2,586,168, and so on, isocyanates described in U.S. Pat. No. 3,103,437, and so on, aziridine compounds described in U.S. Pat. Nos. 3,017,280 and 2,983,611, and so on, acid derivatives described in U.S. Pat. Nos. 2,725,294 and 2,725,295, and so on, carbodimide compounds described in U.S. Pat. No. 3,100,704 and so on, epoxy compounds described in U.S. Pat. No. 3,091,537 and so on, isooxazole compounds described in U.S. Pat. Nos. 3,321,313 and 3,543,292, halogenocarboxyaldehydes like mucochloric acid, dioxane derivatives such as dihydroxydioxane, dichlorodioxane and the like, dihydroquinoline compounds, compounds having a phosphorus-halogen bond, N-sulfonyloxyimide compounds, N-acyloxyimide compounds, N-carbonyloxyimide compounds described in Japanese Patent Application (OPI) No. 43353/81, 2-sulfonyloxypyridinium salts, N-carbamoylpyridinium salts, and so on. Further, inorganic hardeners such as chrome alum, zirconium sulfate, and the like can also be used in combination. Furthermore, instead of the above-described hardeners, those having the form of precursor thereof, e.g., alkali metal bisulfide-aldehyde adducts, methylol derivatives of hydantoin, primary aliphatic nitroalcohols, mesyloxyethysulfonyl compounds, chloroethylsulfonyl compounds and so on, may also be used in combination. When the hardeners of the present invention and other hardeners are used in combination, the hardener of the present invention can be used in any desired fraction, depending upon the purpose and the effect to the achieved. However, it is more desirable that the fraction of the hardener of the present invention is 50 mole% or more.

Moreover, compounds which accelerate the hardening of gelatin can also be used together with the hardeners of the present invention. Examples of such hardening accelerators include aprotic solvents described in German Patent Application (OLS) No. 2,417,558, betaine-form surface active agents described in Japanese Patent Application (OPI) No. 62045/82, teritary amines and their salts (e.g., those described in Japanese Patent Application (OPI) Nos. 1043/81 and 9434/76, German Patent Application (OLS) No. 2,138,305, British Pat. Nos. 1,284,305 and 1,269,983, and so on), various kinds of inorganic salts and polyhydric alcohols. Of course, these hardening accelerators can also be used together with both the hardeners of the present invention and the above-described known hardeners. For instance, polymers having sulfinic acid groups described in Japanese Patent Application (OPI) No. 4141/76 can be employed as hardening accelerator in the system containing both the hardener of the present invention and a hardener of the vinylsulfone type.

Gelatins to which the hardeners of the present invention are applicable may be those which have been soaked in an alkaline bath before the gelatin extraction in the manufacturing process, the so-called alkali processed (or lime processed) gelatins, acid processed gelatins which have been soaked in an acid bath, doubly soaked gelatins which have received both of the above-described processings, or enzyme processed gelatins as described in *Bull. Soc. Sci. Phot Japan,* No. 16, p. 30 (1966). In addition, the hardeners of the present invention are applicable to low molecular weight gelatins obtained by heating the above-described gelatins in a water bath or acting a proteolytic enzyme thereon to hydrolyze in part.

A part of gelatin to which the hardeners of the present invention are applicable can be replaced, if desired, by colloidal albumin, casein, cellulose derivatives such as carboxymethyl cellulose, hydroxyethyl cellulose and the like, sugar derivatives such as agar, sodium alginate, starch derivatives and the like, and synthetic hydrophilic polymers such as polyvinyl alcohol, poly-N-vinylpyrrolidone, acrylic acid copolymers, polyacrylamides, or derivatives and partial hydrolysis products of these polymers. Besides the above-described macromolecular substances, so-called gelatin derivatives prepared by treating and modifying gelatins with such a reagent as to have at least one group reactive to one of functional groups contained in gelatins, such as an amino group, an imino group, a hydroxy group or a carboxyl group, and graft copolymers obtained by grafting molecular chains of other macromolecular substances onto gelatins may be also used in place of gelatins.

Specific examples of reagents which can be employed for producing the above-described derivatives include isocyanates, acid chlorides and acid anhydrides described in U.S. Pat. No. 2,614,928, acid anhydrides described in U.S. Pat. No. 3,118,766, bromoacetic aids described in Japanese Patent Publication No. 5514/64, phenylglycidyl ethers described in Japanese Patent Publication No. 26845/67, vinylsulfone compounds described in U.S. Pat. No. 3,132,945, N-allylvinylsulfonamides described in British Pat. No. 861,414, maleimide compounds described in U.S. Pat. No. 3,186,846, acrylonitriles described in U.S. Pat. No. 2,594,293, polyalkyleneoxides described in U.S. Pat. No. 3,312,553, epoxy compounds described in Japanese Patent Publication No. 26845/67, acid esters described in U.S. Pat. No. 2,763,639, alkanesultones described in British Pat. No. 1,033,189, and so on.

There are many descriptions of branch polymers grafted on gelatin, for example, in U.S. Pat. Nos. 2,763,625, 2,831,767 and 2,956,884, *Polymer Letters,* Vol. 5, p. 595 (1967), *Phot. Sci. Eng.,* Vol. 9, p. 148 (1965), *J. Polymer Sci.,* A-1, 9, 3199 (1971), and so on. A wide variety of homopolymers and copolymers prepared from those which are generally called vinyl monomers, such as acrylic acid, methacrylic acid and their derivatives (e.g., ester, amide, nitrile, etc.), styrene and so on, can be employed as branch polymers. Of these polymers, hydrophilic vinyl polymers which are compatible with gelatin to some degree, such as homo- or copolymers prepared from acrylic acid, acrylamide, methacrylamide, hydroxyalkylacrylate, hydroxyalkylmethacrylate, and/or the like, are preferred over others.

Photographic emulsion layers and other layers to constitute the photographic material of the present invention may additionally contain synthetic polymer compounds, for example, latex polymers of water-dispersible vinyl compounds, especially such compounds as to increase the dimensional stability of a photographic material, singly, as mixture of two or thereof, or in combination with a hydrophilic water-permeating colloid.

The hardeners of the present invention can be used together with a matting agent. A suitable matting agent is fine particles of water-insoluble organic or inorganic compounds. A desirable mean diameter of such fine particles ranges from 0.2 μm to 10 μm, and preferably from 0.3 μm to 5 μm.

The pyrazoloazole magenta couplers may be incorporated in the photographic material of the present invention independently or in combination with two or more thereof. The photographic material may additionally contain cyan couplers and two-equivalent yellow couplers.

Suitable cyan couplers include phenol couplers, naphthol couplers and the like, and suitable two-equivalent yellow couplers are pivaloylacetoanilide two-equivalent couplers, benzoylacetoanilide two-equivalent couplers, malondianilide two-equivalent couplers and the like.

Specific examples of such cyan couplers are described in Japanese Patent Publication Nos. 34733/78, 37822/79, 37823/79, 6539/81 and 3934/82, Japanese Patent Application (OPI) Nos. 14736/79, 48237/79, 66129/79, 65957/80, 1958/81, 12643/81, 27147/81, 116030/81, 126830/81, 73050/80, 80045/81, 104333/81, 204544/82, 204545/82, 200039/82, 42045/83, 98731/83, 105229/83, 118643/83, 187928/83, 189154/83, 211756/83, 31953/84, 40643/84, 35731/85 and 95346/83, U.S. Pat. Nos. 4,072,525, 4,083,721, 4,146,396, 4,228,233, 4,254,212, 4,264,722 and 4,333,999, and so on.

Specific examples of two-equivalent yellow couplers are described in Japanese Patent Publication Nos.

13576/74, 10783/76, 26038/76, 102636/76, 25733/76, 7579/80, 13023/80, 5988/81, 7222/81, 45134/81, 45135/81, 44410/81, 37858/82, 37859/82 and 10739/83, Japanese Patent Application (OPI) Nos. 34232/75, 21827/76, 75521/76, 20023/77, 38576/80, 161239/80, 87041/81, 95237/81, 161543/81, 155538/82, 125039/83 and 139138/83, U.S. Pat. Nos. 2,329,587, 3,227,554, 3,408,194, 3,415,652, 3,541,840, 3,644,498, 3,933,501, 3,990,896, 4,032,347, 4,049,458, 4,133,958, 4,201,584, 4,115,121, 4,157,919, 4,206,278, 4,401,752, 4,404,274 and RE 30,211, German Patent Application (OLS) No. 3,107,137 (Al), British Pat. No. 2,011,398, Japanese Patent Application (OPI) Nos. 214854/84 and 228640/84, *Research Disclosure,* 18053, and so on.

Pyrazoloazole magenta couplers, cyan couplers and yellow two-equivalent couplers as described above may be couplers of the kind which can produce dyes having moderate diffusibility upon development, as described in U.S. Pat. No. 4,420,556.

In addition to the foregoing couplers, yellow couplers and cyan couplers described in Japanese Patent Application No. 76164/84 can also be employed. Further, pyrazoloazole magenta couplers included in the magenta couplers described in the above-described patent specification may also be employed.

Furthermore, so-called polymeric couplers, which contain as constitutional repeating units thereof one or more of a coupler selected from the above-described yellow, magenta or cyan couplers modified so as to have an ethylenic, polymerizing group at a position other than the coupling position and further, noncoloring monomers, if desired, may be used.

The color photographic material of the present invention may further contain couplers capable of releasing development inhibitors upon development (so-called DIR couplers).

Examples of DIR couplers include those which can release heterocyclic mercapto group-containing development inhibitors, as described in U.S. Pat. No. 3,227,554 and so on; those releasing benzotriazole derivatives as development inhibitors, as described in Japanese Patent Publication No. 9942/83 and so on; so-called colorless DIR couplers described in Japanese Patent Publication No. 16141/76 and so on; those releasing nitrogen-containing heterocyclic development inhibitors with decomposition of methylol after elimination, as described in Japanese Patent Application (OPI) No. 90932/77; those releasing development inhibitors with an intramolecular nucleophilic reaction after the release, as described in U.S. Pat. No. 4,248,962; those releasing development inhibitors by electron transfer through a conjugated system after release, as described in Japanese Patent Application (OPI) Nos. 114946/81, 56837/82, 154234/82, 188035/82, 98728/83, 209736/83, 209737/83, 209738/83, 209740/83, and so on; those releasing diffusible development inhibitors whose function is inactivated by diffusing into a developing solution, as described in Japanese Patent Application (OPI) Nos. 151944/82 and 217932/83, and so on; those releasing reactive compounds, and producing development inhibitors or allowing the released development inhibitors to be inactivated by reactions caused in the layers upon development, as described in U.S. application Ser. No. 707,103, filed Feb. 28, 1985, and so on; and the like. Of these DIR couplers, couplers of the type which are inactivated by a developing solution, the representatives of which are those described in Japanese Patent Application (OPI) No. 151944/82; couplers of the timing type, examples of which are described in U.S. Pat. No. 4,248,962 and Japanese Patent Application (OPI) No. 154234/82; and couplers of the reactive type, the representatives of which are those described in U.S. application Ser. No. 707,103, filed Feb. 28, 1985, are more desirable for incorporation in the present invention. Preferred DIR couplers are those of the type which are inactivated by a developing solution as described in Japanese Patent Application (OPI) No. 151944/82 and so on, and the DIR couplers of the reactive type, as described in U.S. application Ser. No. 707,103, filed Feb. 28, 1985 and so on, are employed to greater advantage.

For introducing couplers into silver halide emulsion layers of the photographic material to be prepared in accordance with the present invention, known methods, for example, the method described in U.S. Pat. No. 2,322,027 and so on, are employed. Specifically, after dissolving couplers in high boiling point solvents, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethyl succinate, diethyl azelate, etc.), trimesic acid esters (e.g., tributyl trimesate, etc.) and so on, or organic solvents having boiling points ranging from about 30° C. to 150° C., such as lower alkyl acetates (e.g., ethyl acetate, butyl acetate, etc.), ethyl propionate, secondary butyl alcohol, methyl isobutyl ketone, $\beta$-ethoxyethylacetate, methylcellosolve acetate and the like, they are dispersed into hydrophilic colloids. The above-described high boiling point solvents and low boiling point solvents may be used in a mixed form.

In addition, the dispersing method described in Japanese Patent Publication No. 39853/76 and Japanese Patent Application (OPI) No. 59943/76, in which certain polymers are utilized, can also be employed for the introduction of couplers.

If polymeric couplers are employed, emulsion polymerization products may be added to the the photographic emulsions as is, or polymers which have been prepared in a solution polymerization process and then removed from the solution system may be dissolved again in organic solvents and then, dispersed into emulsions.

Amounts of the pyrazoloazole type couplers to be used in the present invention can be properly chosen depending upon the particular purposes intended to be achieved thereby. In general, they range from $2\times10^{-3}$ to 1 mole per mole of silver halide, particularly from $5\times10^{-3}$ to 0.5 mole per mole of silver halide.

Suitable examples of silver halides which can be used in the color photographic material of the present invention include silver bromide, silver iodobromide, silver iodochlorobromide, silver chlorobromide, and silver chloride.

The present invention is not particularly restricted as to the mean grain size of the silver halide grains in the photographic emulsion ("grain size" as used herein refers to the mean diameter of the grains when the grain have a true or nearly spherical form, while "grain size" corresponds to the mean edge length of the grain when the grains have a cubic form, with the average being determined on the basis of their projection areas). However, it is preferable that the silver halide grains have a mean grain size of 3 μm or less.

The silver halide grains in the photographic emulsions of the present invention may have a regular crystal form, such as that of a cube, or an octahedron; or an irregular crystal form, such as that of sphere, table, or so on; or a composite form thereof. A mixture of various crystal forms of silver halide grains may be also present.

In addition, such emulsions as to contain extremely tabular silver halide grains having a diameter greater than their thickness by a factor of not less than 5 in a proportion of 50% or more to the whole silver halide grains therein, based on their projection areas, may be employed.

The interior and the surface of the silver halide grains may differ. Further, either silver halide grains of the kind which form latent image predominantly at the surface of the grains, or grains of the kind which mainly form latent image inside the grains may be used.

The photographic emulsion employed in the present invention can be prepared using various methods as described, for example, in P. Glafkides, *Chimie et Physique Photographique*, Paul Montel, Paris (1967); G. F. Duffin, *Photographic Emulsion Chemistry*, The Focal Press, London (1966); V. L. Zelikman et al, *Making and Coating Photographic Emulsion*, The Focal Press, London (1966); and so on. Specifically, an acid process, a neutral process, and an ammonia process may be used. As for the methods for reacting a water-soluble silver salt with a water-soluble halide, a single jet method, a double jet method, and a combination thereof may be used.

Also, a method in which silver halide grains are produced in the presence of excess silver ion (the so-called reversal single jet method) can be used. The so-called controlled double jet method, in which the pAg of the liquid phase in which silver halide grains are to be precipitated is maintained constant, may also be employed. According to this method, silver halide emulsion having regular crystal forms and nearly uniform grain sizes can be obtained.

Two or more kinds of silver halide emulsions prepared separately may be employed in a mixed form.

In a process for producing silver halide grains or allowing the produced silver halide grains to ripen physically, cadmium salts, zinc salts, lead salts, thallium salts, iridium salts or complexes, rhodium salts or complexes, ion salts or complexes, and the like may be present.

Removal of soluble salts from the silver halide emulsion is generally carried out after the formation of the silver halide or after physical ripening. The removal can be effected using the noodle washing method, which comprises gelling the gelatin, or using a sedimentation process (causing flocculation in the emulsion) taking advantage of a sedimenting agent such as a polyvalent anion-containing inorganic salt.

The silver halide emulsion of the present invention is, in general, subjected to chemical sensitization. The chemical sensitization can be carried out using the process described, for example, in H. Frieser, *Die Grundlagen der Photographischen Prozesse mit Silberhalogeniden*, pp. 675–734, Akadimische Verlagsgesellschaft (1968).

More specifically, sulfur sensitization using compounds containing sulfur capable of reacting with active gelatin or silver ion (e.g., thiosulfates, thioureas, mercapto compounds, rhodanines, etc.); reduction sensitization using reducing materials (e.g., stannous salts, amines, hydrozine derivatives, formamidinesulfinic acid, silane compounds, etc.); sensitization with noble metal compounds (e.g., gold complex salts, and complex salts of Group VIII metals such as Pt, Ir, Pd, etc.); and so on can be employed individually or as a combination thereof.

The photographic emulsions employed in the present invention can contain a wide variety of compounds for purposes of preventing fogging or stabilizing photographic functions during production, storage or photographic processing. Specifically, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole) and the like; mercaptopyrimidines; mercaptotriazines, thioketo compounds like oxazolinethione; azaindenes such as triazaindenes, tetraazaindenes (especially (1,3,3a,7)tetraazaindenes substituted with a hydroxy group at the 4-position), pentaazaindenes and the like; and compounds known as an antifoggant or a stabilizer, e.g., benzenesulfonic acid, benzenesulfinic acid, benzenesulfonic acid amide, and the like can be added to the photographic emulsions.

The photographic emulsion layers or other hydrophilic colloid layers of the photosensitive material prepared in accordance with the present invention may contain surface active agents for various purposes, such as coating aids, prevention of electrification, improvement of slipping properties, emulsifying the dispersion, prevention of adhesion, and improvement in the photographic characteristics (e.g., development acceleration, high contrast, sensitization, etc.).

The photographic emulsion layers of the present photosensitive material may contain, for example, polyalkylene oxides and derivatives thereof, such as the ethers, the esters and the amides thereof, thioether compounds, thiomorpholines, quaternary ammonium salt compounds, urethane derivatives, urea derivatives, imidazole derivatives, 3-pyrazolidones and so on in order to increase the sensitivity and the contrast thereof, or in order to accelerate the developing rate thereof.

The photographic emulsions of the present invention may be spectrally sensitized using methine dyes or other dyes. Suitable spectral sensitizers which can be employed include cyanine dyes, merocyanine dyes, complex cyanine dyes, holopolar cyanine dyes, hemicyanine dyes, styryl dyes and hemioxonol dyes. Especially useful dyes are cyanine dyes, merocyanine dyes, and complex merocyanine dyes. Any nuclei that may be present in cyanine dyes can be the basic heterocyclic nuclei of these dyes. More specifically, such basic heterocyclic nuclei include pyrroline, oxazoline, thiazoline, pyrrole, oxazole, thiazole, selenazole, imidazole, tetrazole, pyridine, and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline, and like nuclei. Each of these nuclei may be substituted with some group on its carbon atoms.

The merocyanine and complex merocyanine dyes can contain 5- or 6-membered heterocyclic nuclei such as pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

These sensitizing dyes may be employed individually or in combination. Combinations of sensitizing dyes are often employed for certain purposes, especially for supersensitization.

Materials which can exhibit a supersensitizing effect in combination with a certain sensitizing dye although they themselves do not spectrally sensitize silver halide emulsions or do not absorb light in the visible region may be incorporated in the silver halide emulsions. For example, aminostilbene compounds substituted with nitrogen-containing heterocyclic groups (such as those described in U.S. Pat. Nos. 2,933,390 and 3,635,721), aromatic organic acid-formaldehyde condensates (such as those described in U.S. Pat. No. 3,743,510), cadmium salts, azaindene compounds, and so on can be incorporated.

The color photographic material of the present invention typically comprises at least one red-sensitive emulsion layer, at least one green-sensitive emulsion layer, and at least one blue-sensitive emulsion layer on a support. The order of these layers can be varied as desired. Usually, cyan-, magenta- and yellow-forming couplers are incorporated in red-, green- and blue-sensitive emulsion layers, respectively. However, different combinations can also be employed, if desired.

When dyes and ultraviolet absorbents are incorporated in hydrophilic colloid layers of the photosensitive material prepared in accordance with the present invention, they may be mordanted with cationic polymers and the like.

The photosensitive material prepared in accordance with the present invention may contain as color fog inhibitor hydroquinone derivatives, aminophenol derivatives, gallic acid derivatives, ascorbic acid derivatives, and the like.

The photosensitive material prepared in accordance with the present invention may contain ultraviolet absorbents in its hydrophilic colloid layers. For example, aryl-substituted benzotriazole compounds (such as those described in U.S. Pat. No. 3,533,794), 4-thiazolidone compounds (such as those described in U.S. Pat. Nos. 3,314,794 and 3,352,681), benzophenone compounds (such as those described in Japanese Patent Application (OPI) No. 2784/71), cinnamic acid ester compounds (such as those described in U.S. Pat. Nos. 3,705,805 and 3,707,375), butadiene compounds (such as described in U.S. Pat. No. 4,045,229), or benzoxazole compounds (such as those described in U.S. Pat. No. 3,700,455) can be used. Also ultraviolet absorbing couplers (such as cyan dye-forming couplers of the α-naphthol type) and ultraviolet absorbing polymers may be used. These ultraviolet absorbents may be mordanted to be fixed to a particular layer.

The photosensitive material prepared in accordance with the present invention may contain, in its hydrophilic colloid layers, water-soluble dyes such as filter dyes, irradiation-preventing dyes, or dyes for various other purposes. Examples of dyes useful for such purposes include oxonol dyes, hemioxonol dyes, styryl dyes, merocyanine dyes, cyanine dyes and azo dyes. Of these dyes, oxonol dyes, hemioxonol dyes, and merocyanine dyes are used to greater advantage.

In the present invention, known discoloration inhibitors can be used. Color image stabilizers also can be used in the present invention, and they may be used alone or in combinations of two or more thereof. Specific examples of known discoloration inhibitors include hydroquinone derivatives (e.g., those described in Japanese Patent Application (OPI) No. 10539/84), gallic acid derivatives, p-alkoxyphenols, p-oxyphenol derivatives, bisphenols, and so on.

The photographic emulsions described in detail above are coated on a planar material which does not cause a marked dimensional change during photographic processing. For example, a hard material such as glass, metal, ceramic and so on, or a flexible material may be employed as a support depending on the end-use purpose of the photosensitive material.

Examples of typical flexible support include conventionally used ones, such as cellulose acetate films, polyethylene terephthalate films, polycarbonate films, laminates made of two or more of these films, baryta-coated paper, paper coated or laminated with an α-olefin polymer, especially a polymer of an α-olefin containing 2 to 10 carbon atoms, such as polyethylene, polypropylene or the like, and so on.

Known processing methods and known processing solutions, as described, e.g., in *Research Disclosure*, Vol. 176, pp. 28–30, can be employed in the photographic processing of the photographic emulsion layers prepared in accordance with the present invention. The processing temperature is generally in the range of from about 18° C. to about 50° C. Of course, temperatures higher than about 50° C. or lower than about 18° C. may be employed.

Fixing solutions which can be used in the present invention include those having conventionally used compositions. Suitable fixing agents contained in the fixing solutions include thiosulfates, thiocyanates and other organic sulfur compounds which have so far been known to have a fixing effect. The fixing solutions may contain a water-soluble aluminium salt as a hardener.

A color developing solution is, in general, an alkaline aqueous solution containing a color developing agent. Suitable examples of color developing agents which can be used include known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.).

In addition to the above-described color developing agents, those described in L. F. A. Mason, *Photographic Processing Chemistry*, pp. 226–229, The Focal Press, London (1966), U.S. Pat. Nos. 2,193,015 and 2,592,364, Japanese Patent Application (OPI) No. 64933/73, and so on, may be also employed.

In addition to color developing agents as described above, the color developing solution can contain pH buffering agents such as sulfites, carbonates, borates and phosphates of alkali metals, a development inhibitor such as bromides, iodides and organic antifoggants, an antifoggant, and so on. Optionally, a water softener, preservatives like hydroxylamines, an organic solvent like benzyl alcohol or diethylene glycol, a development accelerator such as polyethylene glycol, quaternary ammonium salts, amines or so on, competing couplers, a fogging agent like sodium boronhydride, an auxiliary developer like 1-phenyl-3-pyrazolidone, a viscosity imparting agent, chelating agent of the polycarboxylic acid type, an antioxidant, and so on, may be incorporated in the color developing solution.

The photographic emulsion layers which have been color development-processed are generally subjected to a bleach-processing. The bleach-processing may be carried out either simultaneously with or separately from a fix-processing. Suitable examples of bleaching agents which can be used include compounds of polyvalent metals such as Fe(III), Co(III), Cr(IV), Cu(II), etc., peroxy acids, quinones, nitroso compounds, and so on.

More specifically, bleaching agents which can be used are ferricyanides, dichromates, complex salts of Fe(III) or Co(III) and organic acids, such as aminopolycarboxylic acids (e.g., ethylenediaminetetraacetic acid, nitrilotriacetic acid, 1,3-diamino-2-propanoltetraacetic acid, etc.), citric acid, tataric acid, malic acid and so on, persulfates, permanganates, nitrosophenol, and so on. Of these complex salts, potassium ferricyanide, sodium ethylenediaminetetraacetatoferrate(III), and ammonium ethylenediaminetetraacetatoferrate(III) are particularly useful. In particular, (ethylenediaminetetraacetato)iron(III) complex salts are useful in both independent bleaching solution and combined bleaching and fixing bath.

The present invention is illustrated in greater detail by reference to the following examples. However, the invention is not intended to be construed as being limited to these examples.

EXAMPLE 1

A monocolor photosensitive material (Sample 101) having on a cellulose triacetate film support the layers having the compositions described below was prepared as a comparative example.

The First Layer: Green-sensitive emulsion layer containing a silver iodobromide emulsion (having a mean grain diameter of 0.7 μm and an iodine distribution uniform throughout the grain, and containing 3 mol% of silver iodide and 0.3 g/m$^2$ of silver), a silver iodobromide emulsion (having a mean grain diameter of 0.3μ and an iodine distribution uniform throughout the grain, and containing 3 mol% of silver iodine and 0.1 g/m$^2$ of silver), 0.8 g/m$^2$ of gelatin, $5\times10^{-4}$ mol/mol silver of a sensitizing dye 0–2, $2\times10^{-4}$ mol/mol silver of a sensitizing dye 0–2, 0.3 g/m$^2$ of a coupler Cp-1, and 0.2 g/m$^2$ of OIL-1. Structural formulae of these ingredients are shown below.

The Second Layer: Protective layer containing 0.5 g/m$^2$ of fine-grained silver bromide having a mean grain diameter of 0.07 μm, 1 g/m$^2$ of gelatin, 0.2 g/m$^2$ of polymethylmethacrylate particles (having a diameter of about 1.5 μm, and 0.4 g/m$^2$ of a hardener HA-1 of the structural formula shown below.

Another monocolor photosensitive material (Sample 102) was prepared in the same manner as Sample 101 except that the hardener HA-1 was removed, and the hardener H-3 was used instead thereof in the molar quantity greater than that of the hardener HA-1 by a factor of 4.5.

Still another monocolor photosensitive material (Sample 103) was prepared in the same manner as Sample 101 except that the magenta coupler Cp-1 was removed, and the present magenta coupler M-5 was used instead thereof in the molar quantity greater than that of the magenta coupler Cp-1 by a factor of 0.6.

Further, a monocolor photosensitive material of the present invention (Sample 104) was prepared in the same manner as Sample 101 except that the hardener HA-1 was removed and the present hardener H-3 was used instead thereof in a molar quantity greater than that of the hardener HA-1 by a factor of 4.5 and further, the magenta coupler Cp-1 was removed and the present magenta coupler M-5 was used instead thereof in the molar quantity greater than that of the magenta coupler Cp-1 by a factor of 0.6.

Each of the thus obtained samples 101 to 104 was wedgewise exposed to white light of 4800° K. and then, subjected to photographic processing. Thereafter, sensitometry was carried out using a densitometer equipped with a Status-M filter. The results obtained are shown in Table 1.

Furthermore, photosensitive materials (Samples 105 to 108) were prepared in the same manner as Sample 104 except that the present hardener H-3 was substituted for the present hardeners H-14, H-17, H-18 and H-19, respectively. These samples 105 to 108 also had effects equivalent to that of Sample 104.

TABLE 1

| | Hardener | Amount Added (Molar Ratio) | Magenta Coupler | Amount Added (Molar Ratio) | Rate of After-hardening (*1) | Rate of drop in Dm due to Change from HA-1 to H-3 |
|---|---|---|---|---|---|---|
| Sample 101 (Comparison) | HA-1 | 1 | Cp-1 | 1 | 0.25 | 10% |
| Sample 102 (Comparison) | H-3 | 4.5 | Cp-1 | 1 | 0 | 10% |
| Sample 103 (Comparison) | HA-1 | 1 | M-1 | 0.6 | 0.25 | 0% |
| Sample 104 (Invention) | H-3 | 4.5 | M-5 | 0.6 | 0 | 0% |

(*1) Rate of after-hardening is defined by the following equation using a sample which has been stored at a temperature of 25° C. under relative humidity of 55% after the coating procedure.

$$\text{Rate of hardening} = \frac{\text{Thickness in swelled condition (48 hr)} - \text{Thickness in swelled condition (168 hr)}}{\text{Thickness in dried condition}}$$

The structural formulae of the compounds employed herein are illustrated below.

O-1

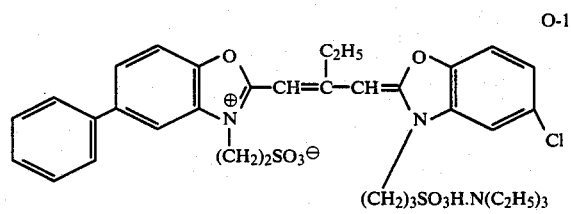

-continued

O-2

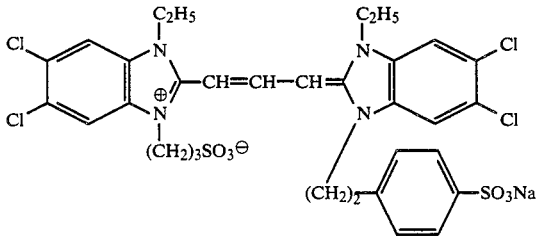

Cp-1

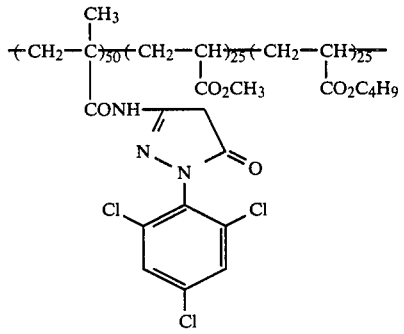

OIL-1

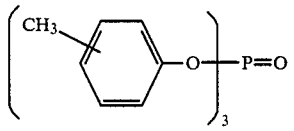

HA-1

$(CH_2{=}CHSO_2CH_2CONHCH_2)_2$

EXAMPLE 2

A multilayer multicolor photosensitive material (Sample 201) containing on a cellulose triacetate film support the layers having the compositions described below in this order was prepared as a comparative example.

The first layer: Antihalation layer containing 0.2 g/m$^2$ (on a solid basis) of black colloidal silver, 1.5 g/m$^2$ of gelatin, 0.1 g/m$^2$ of UV-1 of the structural formula shown below, 0.2 g/m$^2$ of UV-2 having the structural formula shown below, 0.01 g/m$^2$ of OIL-1 having the structural formula shown above, and 0.01 g/m$^2$ of OIL-2 having the structural formula shown below.

The second layer: Interlayer containing 0.15 g/m$^2$ of fine-grained silver bromide (having a mean grain diameter of 0.07$\mu$), 1.0 g/m$^2$ of gelatin, 0.1 g/m$^2$ of a colored coupler Cp-12 having the structural formula shown below, 0.01 g/m$^2$ of the other colored coupler Cp-2 having the structural formula shown below, and 0.1 g/m$^2$ of OIL-1.

The third layer: First red-sensitive emulsion layer containing a silver iodobromide emulsion (having a mean grain diameter of 0.7 $\mu$m and an iodine distribution uniform throughout the grain, and containing 3 mol% of silver iodide and 0.5 g/m$^2$ of silver), the other silver iodobromide emulsion (having a mean grain diameter of 0.3 $\mu$m and an iodine distribution uniform throughout the grain, and containing 3 mol% of silver iodide and 0.2 g/m$^2$ of silver), 2.5 g/m$^2$ of gelatin, $4.5\times10^{-4}$ mol/mol silver of a sensitizing dye P-1 of the structural formula shown below, $1.5\times10^{-4}$ mol/mol silver of the other sensitizing dye P-2 having the structural formula shown below, 0.5 g/m$^2$ of a coupler Cp-3 having the structural formula shown below, 0.02 g/m$^2$ of a DIR coupler Cp-4 having the structural formula shown below, 0.11 g/m$^2$ of a colored coupler Cp-2 having the structural formula shown below, 0.3 g/m$^2$ of OIL-1 and 0.3 g/m$^2$ of OIL-2.

The fourth layer: Second red-sensitive emulsion layer containing a silver iodobromide emulsion (prepared using a single jet method, having a mean grain diameter of 1.0 $\mu$m and such an iodine distribution as to be non-uniform inside the grain and among the grains, and containing 10 mol% of silver iodide and 1.2 g/m$^2$ of silver), 1.5 g/m$^2$ of gelatin, $3\times10^{-4}$ mol/mol silver of the sensitizing dye P-1, $1\times10^{-4}$ mol/mol silver of the sensitizing dye P-2, 0.2 g/m$^2$ of the coupler Cp-3, 0.04 g/m$^2$ of the colored coupler Cp-2, 0.12 g/m$^2$ of OIL-1, and 0.12 g/m$^2$ of OIL-2.

The fifth layer: Third red-sensitive emulsion layer containing a silver iodobromide emulsion (containing spherical grains having a mean diameter of 2.0 $\mu$m due to use of ammonia during the grain formation, 7 mol% of silver iodide and 2 g/m$^2$ of silver), 2 g/m$^2$ of gelatin, $2\times10^{-4}$ mol/mol silver of the sensitizing dye P-1, $0.6\times10^{-4}$ mol/mol silver of sensitizing dye P-2, 0.17 g/m$^2$ of a coupler Cp-10 having the structural formula shown below, 0.04 g/m$^2$ of the colored coupler Cp-2, 0.12 g/m$^2$ of OIL-1, and 0.12 g/m$^2$ of OIL-2.

The sixth layer: Interlayer containing 1.0 g/m$^2$ of gelatin, 0.2 g/m$^2$ of a color mixing inhibitor Cp-5 having the structural formula shown below, 0.1 g/m$^2$ of OIL-1, and 0.1 g/m$^2$ of OIL-2.

The seventh layer: First green-sensitive emulsion layer containing a silver iodobromide emulsion (having a mean grain diameter of 0.7 $\mu$m and an iodine distribution uniform throughout the grain, and containing 3 mol% of silver iodide and 0.3 g/m$^2$ of silver), another silver iodobromide emulsion (having a mean grain diameter of 0.3 $\mu$m and an iodine distribution uniform throughout the grain, and containing 3 mol% of silver iodide and 0.1 g/m$^2$ of silver), 0.8 g of gelatin, $5\times10^{-4}$ mol/mol silver of the sensitizing dye 0-1, $2\times10^{-4}$ mol/mol silver of the sensitizing dye 0-2, 0.27 g/m$^2$ of the coupler Cp-1, 0.05 g/m$^2$ of a DIR coupler Cp-6 having the structural formula shown below, 0.06 g/m$^2$ of a colored coupler Cp-7 having the structural formula shown below, and 0.2 g/m$^2$ of OIL-1.

The eighth layer: Second green-sensitive emulsion layer containing a silver iodobromide emulsion (prepared using a single jet method, having a mean grain diameter of 1.0 $\mu$m and such an iodine distribution as to be non-uniform inside the grain and among the grains, and containing 10 mol% of silver iodide and 1 g/m$^2$ of silver), 1 g/m$^2$ of gelatin, $3.5\times10^{04}$ mol/mol silver of the sensitizing dye 0-1, $1.4\times10^{-4}$ mol/mol silver of the sensitizing dye 0-2, 0.22 g/m$^2$ of the coupler Cp-1, 0.05 g/m$^2$ of the colored coupler Cp-7, and 0.15 g/m$^2$ of OIL-1.

The ninth layer: Third green-sensitive emulsion layer containing a silver iodobromide emulsion (containing spherical grains having a mean grain diameter of 2.0 $\mu$m due to use of ammonia upon the grain formation, 7 mol% of silver iodide and 2 g/m$^2$ of silver), 2 g/m$^2$ of gelatin, $2\times10^{-4}$ mol/mol silver of the sensitizing dye 0-1, $0.8\times10^{-4}$ mol/mol silver of the sensitizing dye 0-2, 0.14 g/m$^2$ of the coupler Cp-1, 0.03 g/m$^2$ of the colored coupler Cp-7, and 0.2 g/m$^2$ of the coupler Cp-1, 0.03 g/m$^2$ of the colored coupler Cp-7, and 0.2 g/m$^2$ of OIL-1.

The tenth layer: Yellow filter layer containing 0.04 g/m$^2$ (on a solids basis) of yellow colloidal silver, 1 g/m$^2$ of gelatin, 0.2 g/m$^2$ of the color mixing inhibitor Cp-5, 0.1 g/m$^2$ of OIL-1, and 0.1 g/m$^2$ of OIL-2.

The eleventh layer: First blue-sensitive emulsion layer containing a silver iodobromide emulsion (having a mean grain diameter of 0.7 μm and an iodine distribution uniform throughout the grain, and containing 3 mol% of silver iodide and 0.2 g/m$^2$ of silver), the other silver iodobromide emulsion (having a mean grain diameter of 0.3 μm and an iodine distribution uniform throughout the grain, and containing 3 mol% of silver iodide and 0.7 g/m$^2$ of silver), 1.2 g/m$^2$ of gelatin, $3\times10^{-4}$ mol/mol silver of a sensitizing dye 0-3 having the structural formula shown below, 0.7 g/m$^2$ of a coupler Cp-8 having the structural formula shown below, 0.03 g/m$^2$ of a DIR coupler Cp-11 having the structural formula shown below, and 0.5 g/m$^2$ of OIL-1.

The twelfth layer: Second blue-sensitive emulsion layer containing a silver iodobromide emulsion (prepared using a single jet method, having a mean grain diameter of 1.0 μm and such an iodine distribution as to be uniform both inside the grain and among the grains, and containing 10 mol% of silver iodide and 0.3 g/m$^2$ of silver), 0.4 g/m$^2$ of gelatin, $2\times10^{-4}$ mol/mol silver of the sensitizing dye 0-3, 0.3 g/m$^2$ of the coupler Cp-8, and 0.2 g/m$^2$ of OIL-1.

The thirteenth layer: Third blue-sensitive emulsion layer containing a silver iodobromide emulsion (containing spherical grains having a mean diameter of 2.0 μm due to the use of ammonia during the grain formation, 7 mol% of silver iodide and 1 g/m$^2$ of silver, 0.7 g/m$^2$ of gelatin, $1.5\times10^{-4}$ mol/mol silver of the sensitizing dye 0-3, 0.2 g/m$^2$ of the coupler Cp-8, and 0.14 g/m$^2$ of OIL-1.

The fourteenth layer: First protective layer containing 1.5 g/m$^2$ of gelatin, 0.1 g/m$^2$ of the ultraviolet absorbent UV-1, 0.2 g/m$^2$ of the ultraviolet absorbent UV-2, 0.01 g/m$^2$ of OIL-1, and 0.01 g/m$^2$ of OIL-2.

The fifteenth layer: Second protective layer containing 0.5 g/m$^2$ of fine-grained silver bromide (having a mean grain diameter of 0.07 μm), 1 g/m$^2$ of gelatin, 0.2 g/m$^2$ of polymethylmethacrylate particles (diameter: about 1.5 μm), 0.02 g/m$^2$ of a charge controlling agent W-1 having the structural formula shown below, 0.4 g/m$^2$ of the hardener HA-1, and 1 g/m$^2$ of a formaldehyde scavenger S-1 having the structural formula shown below.

Another multicolor photosensitive material (Sample 202) was prepared for comparison in the same manner as Sample 201 except that the hardener contained in the fifteenth layer was substituted for 1.1 g/m$^2$ of the present hardener H-19.

Still another multicolor photosensitive material (Sample 203) was prepared for comparison in the same manner as Sample 201 except that the coupler Cp-1 contained in the seventh layer, the eighth layer and the ninth layer, respectively, was substituted for the present coupler M-1, the coverage of the coupler M-1 in each layer was adjusted to 0.7 time by weight that of the coupler Cp-1 in the corresponding layer, and that the hardener contained in the fifteenth layer was substituted for 1.1 g/m$^2$ of the hardener H-19.

Furthermore, a multicolor photosensitive material (Sample 204) was prepared for comparison in the same manner as Sample 201 except that the modification described below were made.

(1) the coupler Cp-1 contained in the 7th, the 8th and the 9th layers each was substituted for the present coupler M-5, and the coverage of the coupler M-5 was 0.8 time by weight that of the coupler Cp-1 in the corresponding layer.

(2) the coverge of the emulsion in each of the 7th to 9th layers was decreased to 0.6 time by weight.

(3) the hardener contained in the fifteenth layer was substituted for 1.1 g/m$^2$ of the present hardener H-19.

The thus obtained samples 201 to 204 were allowed to stand for 7 days under an atmosphere of 25° C. and 55% RH and thereafter, exposed wedgewise (i.e., through an optical wedge) to white light of 4800° K. and subjected to the processing described below. Sensitometry of the thus processed samples each was carried out using a densitometer equipped with a Status-M filter. The results obtained are shown in Table 2. Therein, $\overline{G}_{1.0}$ referes to the difference between the density of fog+0.2 and the density obtained when the exposure corresponding to LogE+1.0 (wherein E is the exposure with which a density of fog+0.2 is attained) is carried out (in the green-sensitive layer).

It is apparent from the results in Table 2 that the present samples 204 and 206 do not present such a phenomenon that low contrast image is formed due to poor caloration of couplers incorporated in a green-sensitive layer, while considerably low contrast image is observed in Sample 202 (comparison) which contains a combination of quick hardener H-19 and 4-equivalent 5-pyrazolone coupler Cp-1. On the other hand, Sample 201 has no advantage on quick hardening.

TABLE 2

| Sample | $G_{1.0}$ |
|---|---|
| 201 (Comparison) | 0.65 |
| 202 (Comparison) | 0.52 |
| 203 (Invention) | 0.65 |
| 204 (Invention) | 0.66 |

Structural formulae of the compounds employed in the above-described samples are illustrated below.

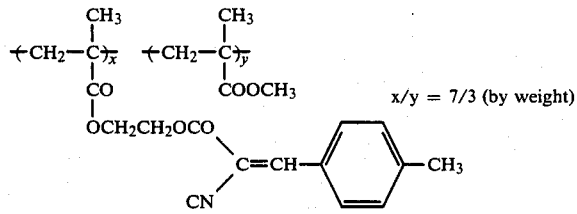

UV-1

-continued
UV-2
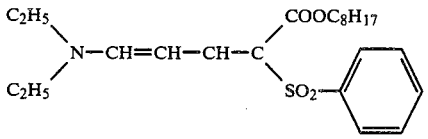
OIL-2
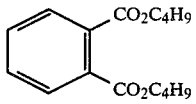
Cp-2
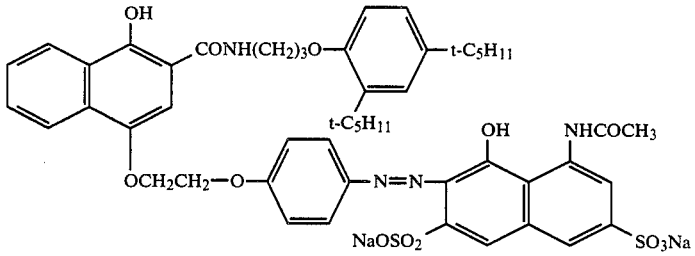
Cp-3
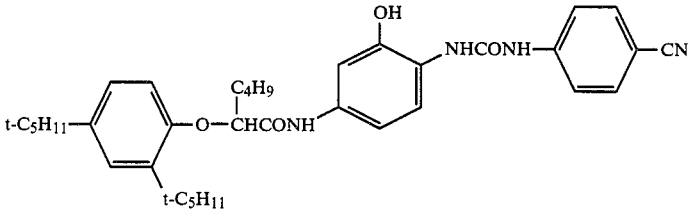
Cp-4
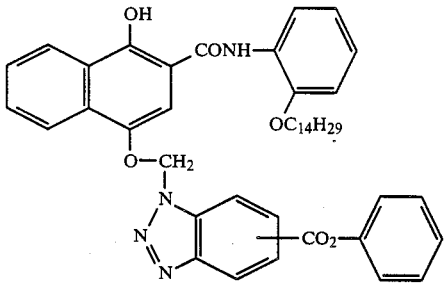
Cp-5
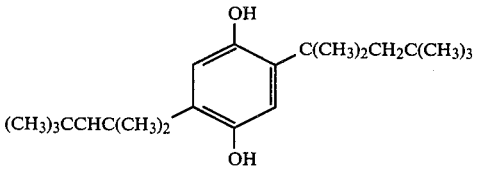
Cp-6
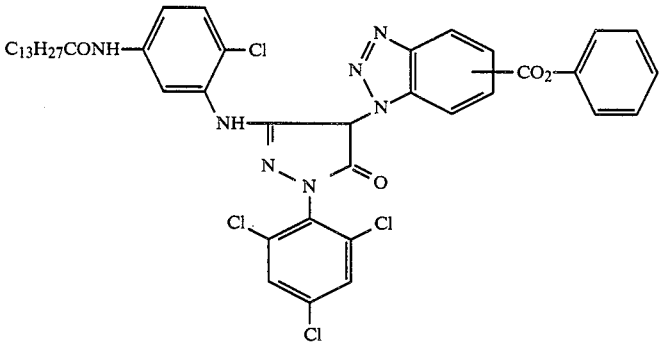

-continued
Cp-7
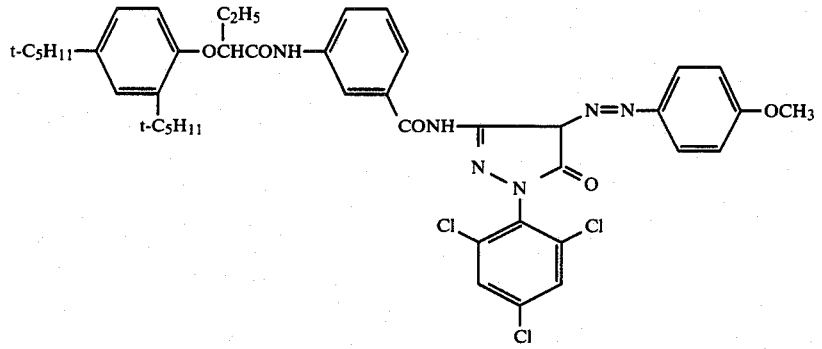
Cp-8
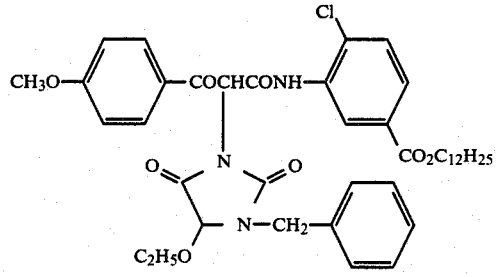
Cp-9
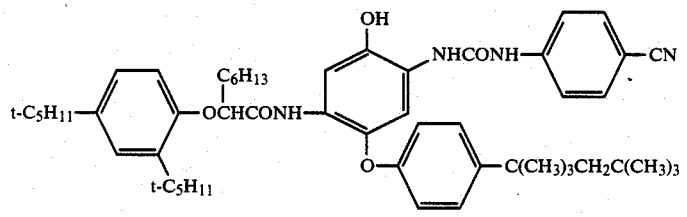
Cp-10
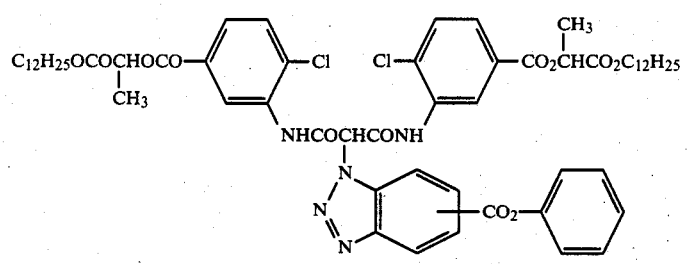
Cp-11
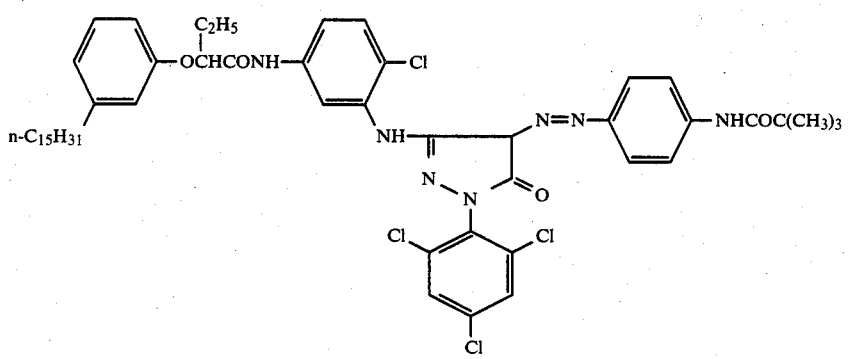
O-3
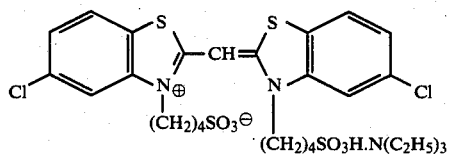

-continued

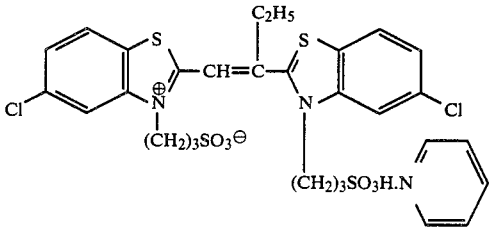

P-1

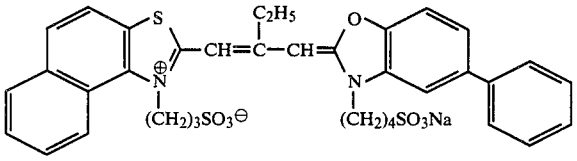

P-2

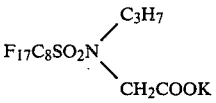

W-1

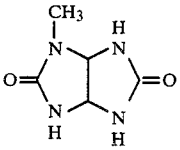

S-1

The development processing employed herein is described below. All steps included in the development processing were carried out at a temperature of 38° C.

| Steps | Time |
|---|---|
| 1. Color Development | 3 min. 15 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilizing | 3 min. 15 sec. |

The processing solution used in the above-described steps respectively had the following compositions.

| | |
|---|---|
| Color Developing Solution | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β- hydroxyethylamino)-2-methylaniline sulfate | 4.5 g |
| Water to make | 1 l |
| Bleaching Solution | |
| Ammonium bromide | 160.0 g |
| Ammonium water (28%) | 25.0 ml |
| Sodium ethylenediaminetetra-acetonatoferrate | 130.0 g |
| Glacial acetic acid | 14.0 g |
| Water to make | 1 l |
| Fixing Solution | |
| Sodium tetrapolyphosphate | 2.0 g |
| Sodium sulfite | 4.0 g |
| Ammonium thiosulfate (70%) | 175.0 ml |
| Sodium hydrogen sulfite | 4.6 g |
| Water to make | 1 l |
| Stabilizing Solution | |
| Formaldehyde (37% aq. soln.) | 8.0 ml |
| Water to make | 1 l |

EXAMPLE 3

On a sheet of paper laminated with polyethylene film on both sides thereof were coated the first layer (the lowest layer) to the seventh layer (the topmost layer) as described in Table 3 to prepare a color photographic material (Sample A).

A coating composition for forming the first layer described above was prepared as follows: 1000 g of the yellow coupler set forth in Table 3 was dissolved in the solvent composed of 166.7 ml of dibutyl phthalate (DBP) and 200 ml of ethyl acetate, and the resulting solution was dispersed, in an emulsified condition, into 800 ml of a 10% aqueous solution of gelatin containing 80 ml of a 1% aqueous solution of sodium dodecylbenzenesulfonate. The thus obtained dispersion was mixed with 1450 g of a blue-sensitive silver chlorobromide emulsion (containing 80 mol% of silver bromide and 66.7 g of silver) to prepare the coating composition. Also, coating compositions for other layers were prepared in a similar manner as described above. In each layer, the present hardener H-19 was incorporated.

Spectral sensitizers employed in the above-described emulsions, respectively, are set forth below.

Blue-sensitive Emulsion Layer 3,3'-di-(γ-sulfopropyl)-selenacyanine sodium salt ($2\times10^{-4}$ mol per mol of silver halide)

Green-sensitive Emulsion 3,3'-di-(γ-sulfopropyl)-5,5'-diphenyl-9-ethyloxacarbocyanine sodium salt ($2.5\times10^{-5}$ mol per mol of silver halide)

Red-sensitive Emulsion 3,3'-di-(γ-sulfopropyl)-9-methyl-thiadicarbocyanine sodium salt ($2.5\times10^{-4}$ mol per mol of silver halide)

Anti-irradiation dyes employed in the emulsion layers, respectively, are illustrated below.

Green-sensitive Emulsion Layer:

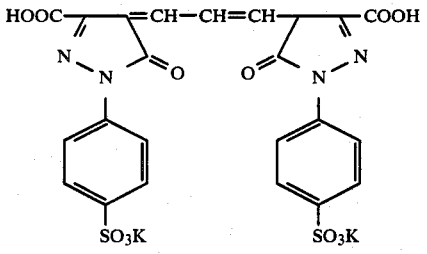

Red-sensitive Emulsion Layer:

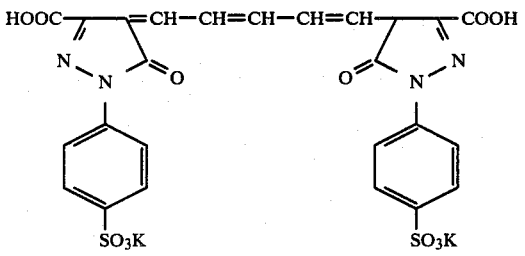

In Table 3, TOP represents tri(n-octyl phosphate), and DBP represents dibutyl phthalate. The compounds a to h set forth in Table 3 have the following structural formulae, respectively.

a. Ultraviolet Absorbent

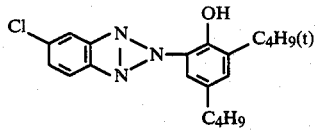

b. Ultraviolet Absorbent

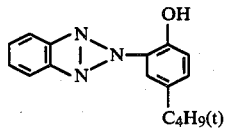

c. Ultraviolet Absorbent

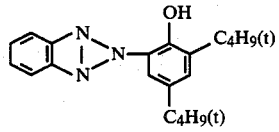

d. Cyan Coupler

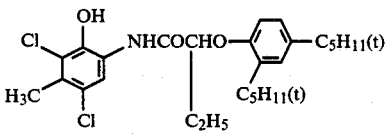

e. Magenta Coupler

-continued

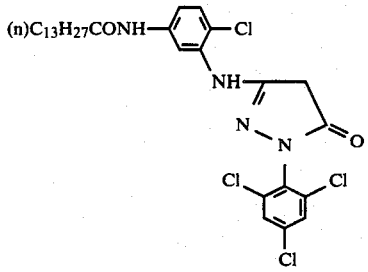

f. Discoloration Inhibitor

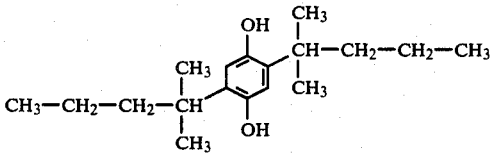

g. Discoloration Inhibitor

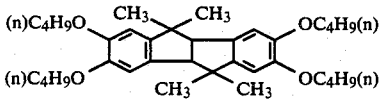

h. Yellow Coupler

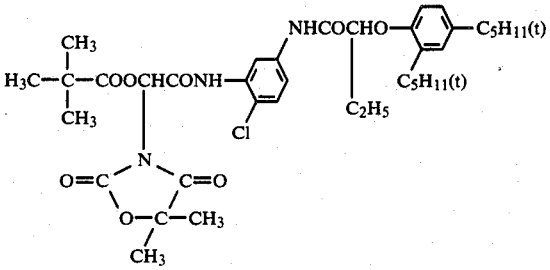

Another color photographic material (Sample B) was prepared in the same manner as Sample A except that the magenta coupler e was substituted for 300 g/m$^2$ of the magenta coupler M-5, and the coverage of the silver chlorobromide emulsion was changed to 200 mg/m$^2$.

TABLE 3

| | | |
|---|---|---|
| The 7th Layer (Protective Layer) | Gelatin | 1500 mg/m$^2$ |
| The 6th Layer (Ultraviolet Absorbing Layer) | Ultraviolet Absorbents (a/b/c) | 50/150/300 mg/m$^2$ |
| | Ultraviolet Absorbent Solvent (DBP) | 200 mg/m$^2$ |
| | Gelatin | 1500 mg/m$^2$ |
| The 5th Layer (Red-sensitive Emulsion Layer) | Silver Chlorobromide Emulsion (bromide content: 50 mol %) | silver 300 mg/m$^2$ |
| | Cyan Coupler (d) | 400 mg/m$^2$ |
| | Ultraviolet Absorbents (a/b/c) | 20/50/60 mg/m$^2$ |
| | Cyan Coupler Solvent (DBP) | 240 mg/m$^2$ |
| | Gelatin | 600 mg/m$^2$ |
| The 4th Layer (Ultraviolet Absorbing Layer) | Ultraviolet Absorbents (a/b/c) | 15/45/90 mg/m$^2$ |
| | Ultraviolet Absorbent Solvent (DBP) | 60 mg/m$^2$ |
| | Gelatin | 1000 mg/m$^2$ |
| The 3rd Layer | Silver Chlorobromide Emulsion (bromide content: 70 mol %) | silver 450 mg/m$^2$ |
| | Magenta Coupler (e) | 350 mg/m$^2$ |
| | Discoloration Inhibitors (f/g) | 50/100 mg/m$^2$ |

TABLE 3-continued

| | | |
|---|---|---|
| | Magenta Coupler | 440 mg/m$^2$ |
| | Solvent (TOP) | |
| | Gelatin | 1000 mg/m$^2$ |
| The 2nd Layer (Color Mixing Preventing Layer) | Gelatin | 1500 mg/m$^2$ |
| The 1st Layer (Blue-Sensitive Emulsion Layer) | Silver Chlorobromide Emulsion (bromide content: 80 mol %) | silver 400 mg/m$^2$ |
| | Yellow Coupler (h) | 600 mg/m$^2$ |
| | Yellow Coupler | 1000 mg/m$^2$ |
| | Solvent (DBP) | |
| | Gelatin | 1200 mg/m$^2$ |
| Support | Paper support laminated with polyethylene on both sides thereof | |

Each of these samples was exposed to green light through continuous wedge, and then subjected to development processing described below.

| Developing Step | Temperature | Time |
|---|---|---|
| Development | 33° C. | 3 min 30 sec |
| Bleach-Fix | 33° C. | 1 min 30 sec |
| Washing | 28° C.-35° C. | 3 min |

The processing solutions used in the above-described steps respectively had the following compositions.

| | |
|---|---|
| Developing Solution | |
| Benzyl alcohol | 15 ml |
| Diethylene glycol | 8 ml |
| Disodium ethylenediaminetetraacetate | 5 g |
| Sodium sulfite | 2 g |
| Hydroxylamine sulfate | 3 g |
| 4-Amino-N—ethyl-N—(β-methanesulfonamidoethyl)-m-toluidine.$\frac{2}{3}$ sulfate monohydrate | 5 g |
| Water to make | 1 l |
| Bleach-Fix Bath | |
| Disodium ethylenediaminetetraacetate | 2 g |
| Ethylenediaminetetraacetonatoiron(III) salt | 40 g |
| Sodium sulfite | 5 g |
| Ammonium thiosulfate | 70 g |
| Water to make | 1000 ml (pH was adjusted to 6.80) |

Color densities of the developed images in the thus processed samples were measured. Fog, gamma, sensitivity and maximum density of each sample are shown in Table 4.

TABLE 4

| | Sample A | Sample B |
|---|---|---|
| Fog | 0.12 | 0.12 |
| Gamma | 2.22 | 2.78 |
| Sensitivity | 1.46 | 1.65 |
| Maximum Density | 1.97 | 2.81 |
| Remark | Comparison | Invention |

As can be seen from the results in Table 4, the sample prepared for comparison was inferior in both sensitivity and maximum density, and did not produce an image of satisfactorily high color density. On the other hand, the sample of the present invention did produce image of sufficiently high color density.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material containing a hardener capable of exerting a hardening effect through activation of a carboxyl group and a magenta coupler of the pyrazoloazole type represented by formula (I)

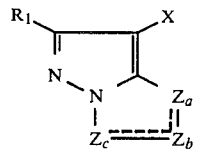

(I)

wherein $R_1$ represents a hydrogen atom or a certain substituent group; X represents a hydrogen atom or a group capable of being split off by a coupling reaction with an oxidized aromatic primary amine developing agent; and $Z_a$, $Z_b$ and $Z_c$ each represents a methine group, a substituted methine group, =N— or —NH—; or the pyrazoloazole type coupler is a dimeric coupler, a polymeric coupler or a macromolecular coupler, each having a unit of the pyrazoloazole compound represented by the formula (I).

2. A silver halide color photographic material as in claim 1, wherein the pyrazoloazole coupler is represented by formula (II)

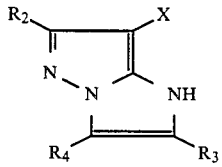

(II)

wherein $R_2$, $R_3$, and $R_4$ each represents a hydrogen atom, a halogen atom, an alkyl group, an alkynyl group, an aryl group, a heterocyclic group, an alkoxy group, an aryloxy group, an acyloxy group, a sulfonyloxy group, an acyl group, a sulfonyl group, a carboxyl group, a sulfo group, a hydroxyl group, an amino group, a carbonamido group, a sulfonamido group, a carbamoyl group, a sulfamoyl group, an alkoxycarbonyl group, an aryloxycarbonyl group, an ureido group, a sulfinyl group, an alkylthio group, an arylthio group, or a cyano group, these groups being substituted or unsubstituted; X represents a hydrogen atom or a group capable of being split off by a coupling reaction with an oxidized aromatic primary amine developing agent.

3. A silver halide color photographic material as in claim 1, wherein the pyrazoloazole coupler is represented by formula (III)

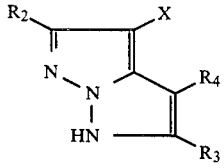

(III)

wherein $R_2$, $R_3$, and $R_4$ each represents a hydrogen atom, a halogen atom, an alkyl group, an alkynyl group, an aryl group, a heterocyclyl group, an alkoxy group, an aryloxy group, an acyloxy group, a sulfonyloxy group, an acyl group, a sulfonyl group, a carboxyl group, a sulfo group, a hydroxyl group, an amino group, a carbonamido group, a sulfonamido group, a carbamoyl group, a sulfamoyl group, an alkoxycarbonyl group, an aryloxycarbonyl group, an ureido group, a sulfinyl group, an alkylthio group, an arylthio group, or a cyano group, these groups being substituted or unsubstituted; X represents a hydrogen atom or a group capable of being split off by a coupling reaction with an oxidized aromatic primary amine developing agent.

4. A silver halide color photographic material as in claim 1, wherein the pyrazoloazole coupler is represented by formula (IV)

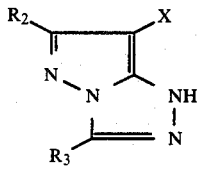

(IV)

wherein $R_2$ and $R_3$ each represent a hydrogen atom, a halogen atom, an alkyl group, an alkynyl group, an aryl group, a heterocyclic group, an alkoxy group, an aryloxy group, an acyloxy group, a sulfonyloxy group, an acyl group, a sulfonyl group, a carboxyl group, a sulfo group, a hydroxyl group, an amino group, a carbonamido group, a sulfonamido group, a carbamoyl group, a sulfamoyl group, an alkoxycarbonyl group, an aryloxycarbonyl group, an ureido group, a sulfinyl group, an alkylthio group, an arylthio group, or a cyano group, these groups being substituted or unsubstituted; X represents a hydrogen atom or a group capable of being split off by a coupling reaction with an oxidized aromatic primary amine developing agent.

5. A silver halide color photographic material as in claim 1, wherein the pyrazoloazole coupler is represented by formula (V)

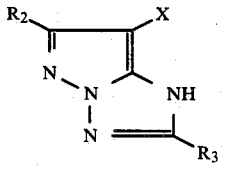

(V)

wherein $R_2$ and $R_3$ each represents a hydrogen atom, a halogen atom, an alkyl group, an alkynyl group, an aryl group, a heterocyclic group, an alkoxy group, an aryloxy group, an acyloxy group, a sulfonyloxy group, an acyl group, a sulfonyl group, a carboxyl group, a sulfo group, a hydroxyl group, an amino group, a carbonamido group, a sulfonamido group, a carbamoyl group, a sulfamoyl group, an alkoxycarbonyl group, an aryloxycarbonyl group, an ureido group, a sulfinyl group, an alkylthio group, an arylthio group, or a cyano group, these groups being substituted or unsubstituted; X represents a hydrogen atom or a group capable of being split off by a coupling reaction with an oxidized aromatic primary amine developing agent.

6. A silver halide color photographic material as in claim 1, wherein the pyrazoloazole coupler is represented by formula (VI)

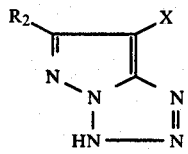

(VI)

wherein $R_2$ represents a hydrogen atom, a halogen atom, an alkyl group, an alkynyl group, an aryl group, a heterocyclic group, an alkoxy group, an aryloxy group, an acyloxy group, a sulfonyloxy group, an acyl group, a sulfonyl group, a carboxyl group, a sulfo group, a hydroxyl group, an amino group, a carbonamido group, a sulfonamido group, a carbamoyl group, a sulfamoyl group, an alkoxycarbonyl group, an aryloxycarbonyl group, an ureido group, a sulfinyl group, an alkylthio group, an arylthio group, or a cyano group, these groups being substituted or unsubstituted; X represents a hydrogen atom or a group capable of being split off by a coupling reaction with an oxidized aromatic primary amine developing agent.

7. A silver halide color photographic material as in claim 1, wherein said hardener is contained in an amount of from 0.05 to 10% by weight based on the amount of dry gelatin, and the pyrazoloazole coupler is contained in an amount of from $5\times10^{-4}$ to 0.5 mole per mole of silver halide.

8. A silver halide color photographic material as in claim 1, wherein said hardener is contained in an amount of from 0.05 to 10% by weight based on the amount of dry gelatin, and the pyrazoloazole coupler is contained in an amount of from $5\times10^{-3}$ to 0.5 mole per mole of silver halide.

9. A silver halide color photographic material as in claim 2, wherein said hardener is contained in an amount of from 0.05 to 10% by weight based on the amount of dry gelatin, and the pyrazoloazole coupler is contained in an amount of from $5\times10^{-3}$ to 0.5 mole per mole of silver halide.

10. A silver halide color photographic material as in claim 3, wherein said hardener is contained in an amount of from 0.05 to 10% by weight based on the amount of dry gelatin, and the pyrazoloazole coupler is contained in an amount of from $5\times10^{-3}$ to 0.5 mole per mole of silver halide.

11. A silver halide color photographic material as in claim 4, wherein said hardener is contained in an amount of from 0.05 to 10% by weight based on the amount of dry gelatin, and the pyrazoloazole coupler is contained in an amount of from $5\times10^{-3}$ to 0.5 mole per mole of silver halide.

12. A silver halide color photographic material as in claim 5, wherein said hardener is contained in an amount of from 0.05 to 10% by weight based on the amount of dry gelatin, and the pyrazoloazole coupler is contained in an amount of from $5\times10^{-3}$ to 0.5 mole per mole of silver halide.

13. A silver halide color photographic material as in claim 6, wheren said hardener is contained in an amount of from 0.05 to 10% by weight based on the amount of dry gelatin, and the pyrazoloazole coupler is contained in an amount of from $5\times10^{-3}$ to 0.5 mole per mole of silver halide.

14. A silver halide color photographic material as in claim 1, wherein said hardener is represented by the formula

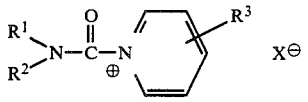

(VII)

wherein $R^1$ and $R^2$, which may be same or different, each represents an alkyl group containing from 1 to 10 carbon atoms, an aryl group containing from 6 to 15 carbon atoms or an aralkyl group containing from 7 to 15 carbon atoms or $R^1$ and $R^2$ combine with each other to form a heterocyclic ring together with the nitrogen atom; $R^3$ represents a hydrogen atom, a halogen atom, a carbamoyl group, a sulfo group, an ureido group, an alkoxy group containing from 1 to 10 carbon atoms, or an alkyl group containing from 1 to 10 carbon atoms and, when present, $X^{\ominus}$ in the foregoing formula represents an anion, which acts as a counter ion to the N-carbamoylpyridinium ion to form a salt, or $X^{\ominus}$ may be absent when $R^3$ contains a sulfo group as a constituent group, whereby an intra-molecular salt is formed.

15. A silver halide color photographic material as in claim 1, wherein said hardener is represented by the formula

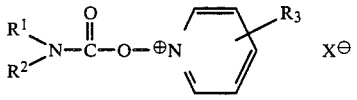

(VIII)

wherein $R^1$ and $R^2$, which may be same or different, each represents an alkyl group containing from 1 to 10 carbon atoms, an aryl group containing from 6 to 15 carbon atoms or an aralkyl group containing from 7 to 15 carbon atoms or $R^1$ and $R^2$ combine with each other to form a heterocyclic ring together with the nitrogen atom; $R^3$ represents a hydrogen atom, a halogen atom, a carbamoyl group, a sulfo group, an ureido group, an alkoxy group containing from 1 to 10 carbon atoms, or an alkyl group containing from 1 to 10 carbon atoms and, when present, $X^{\ominus}$ in the foregoing formula represents an anion, which acts as a counter ion to the N-carbamoylpyridinium ion to form a salt, or $X^{\ominus}$ may be absent when $R^3$ contains a sulfo group as a constituent group, whereby an intra-molecular salt is formed.

16. A silver halide color photographic material as in claim 1, wherein said hardener is represented by the formula

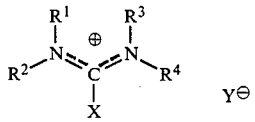

(IX)

wherein $R^1$, $R^2$, $R^3$ and $R^4$, which may be same or different, each represents an alkyl group containing from 1 to 20 carbon atoms, an aralkyl group containing from 6 to 20 carbon atoms, or an aryl group containing from 5 to 20 carbon atoms, whereas it is also possible for any two groups selected from $R^1$, $R^2$, $R^3$ and $R^4$ to combine with each other to form a ring, wherein X in formula (IX) represents a group capable of being split off from the compound of formula (IX) upon reaction with a nucleophilic reagent and wherein $Y^{\ominus}$ in the foregoing formula (IX) represents an anion with the caveat that when any of $R^1$, $R^2$, $R^3$ and $R^4$ has a sulfo group, a hardener of formula (IX) can form an intramolecular salt without any independent counteranion represented by $Y^{\ominus}$.

17. A silver halide color photographic material as in claim 1, wherein said hardener is represented by the formula $$R^1-N=C=N-R^2 \qquad (X)$$

wherein $R^1$ represents an alkyl group containing from 1 to 10 carbon atoms, a cycloalkyl group containing from 5 to 8 carbon atoms, an alkoxyalkyl group containing from 3 to 10 carbon atoms, or an aralkyl group containing from 7 to 15 carbon atoms and wherein $R^2$ represents a group of the following formula in addition to the groups defined for $R^1$:

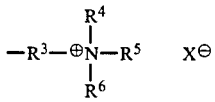

wherein $R^3$ represents an alkylene group containing from 2 to 4 carbon atoms; $R^4$ and $R^5$, which may be same or different, each represents an alkyl group containing from 1 to 6 carbon atoms, or combine with each other to form a heterocyclic ring together with a nitrogen atom; $R^6$ represents an alkyl group containing 1 to 6 carbon atoms and $X^{\ominus}$ represents an anion with the caveat that when the hardener of formula (X) forms an intramolecular salt, the counteranion represented by $X^{\ominus}$ is not necessary.

18. A silver halide color photographic material as in claim 1, wherein said hardener is represented by the formula

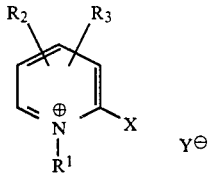

(XI)

wherein $R^1$ represents an alkyl group containing from 1 to 10 carbon atoms, an aryl group containing from 6 to 15 carbon atoms or an aralkyl group containing from 7 to 15 carbon atoms, $R^2$ and $R^3$ in formula (XI), which may be same or different, each represents a hydrogen atom, a halogen atom, an acylamido group, a nitro group, a carbamoyl group, an ureido group, an alkoxy group, an alkyl group, an alkenyl group, an aryl group, or an aralkyl group and $R^2$ and $R^3$ can also combine with each other and form a condensed ring together with the pyridinium ring skeleton; X in the formula (XI) represents a group split off from the compound represented by the formula (XI) upon reaction with a nucleophilic reagent; $Y^{\ominus}$ in formula (XI) represents an anion, with the caveat that $Y^{\ominus}$ may be absent when $R^{\ominus}$ is a sulfo-substituted group, wherein the compound forms an intramolecular salt.

19. A silver halide color photographic material as in claim 1, wherein said hardener is represented by the formula:

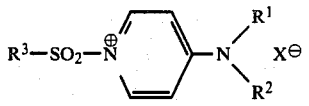

wherein $R^1$ and $R^2$, which may be same or different, each represents an alkyl group containing from 1 to 10 carbon atoms, an aryl group containing from 6 to 15 carbon atoms or an aralkyl group containing from 7 to 15 carbon atoms or $R^1$ and $R^2$ combine with each other to form a heterocyclic ring together with the nitrogen atom, and $R^3$ represents an alkyl group containing from 1 to 10 carbon atoms, an aryl group containing from 6 to 15 carbon atoms or an aralkyl group containing from 7 to 15 carbon atoms and $X^-$ represents an anion.

* * * * *